US008244547B2

(12) United States Patent
Sudo et al.

(10) Patent No.: US 8,244,547 B2
(45) Date of Patent: Aug. 14, 2012

(54) SIGNAL BANDWIDTH EXTENSION APPARATUS

(75) Inventors: Takashi Sudo, Fuchu (JP); Kimio Miseki, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 405 days.

(21) Appl. No.: 12/549,659

(22) Filed: Aug. 28, 2009

(65) Prior Publication Data

US 2010/0057476 A1 Mar. 4, 2010

(30) Foreign Application Priority Data

Aug. 29, 2008 (JP) ..... 2008-222291

(51) Int. Cl.
*G10L 19/00* (2006.01)

(52) U.S. Cl. ..... 704/500; 704/258; 704/226; 704/203

(58) Field of Classification Search ..... 704/500, 704/258, 226
See application file for complete search history.

(56) References Cited

U.S. PATENT DOCUMENTS

| | | | | |
|---|---|---|---|---|
| 5,970,441 | A * | 10/1999 | Mekuria | 704/207 |
| 6,704,711 | B2 * | 3/2004 | Gustafsson et al. | 704/258 |
| 7,546,237 | B2 * | 6/2009 | Nongpiur et al. | 704/209 |
| 2002/0128839 | A1 * | 9/2002 | Lindgren et al. | 704/258 |
| 2009/0176449 | A1 | 7/2009 | Tashiro | |
| 2009/0278573 | A1 | 11/2009 | Tashiro | |

FOREIGN PATENT DOCUMENTS

| | | | |
|---|---|---|---|
| JP | 08-248997 | A | 9/1996 |
| JP | 09-055778 | A | 2/1997 |
| JP | 2006-349848 | A | 12/2006 |
| JP | 2007-164041 | A | 6/2007 |
| WO | WO 2007/135786 | A1 | 11/2007 |

OTHER PUBLICATIONS

Japanese Office Action dated Aug. 24, 2010 and English translation thereof in counterpart Japanese Application No. 2008-222291.

Naofumi Aoki; A Band Extension Technique of Narrow Band Telephony Speech Based on Full Wave Rectification; vol. 107, No. 551; IEICE Technical Report; The Institute of Electronics, Information and Communication Engineers, ; (Mar. 13, 2008); pp. 163-166.

Acoustical Society of Japan Transactions (Oct. 1994) entitled Telephone Speech Enhancement by Bandwidth Expansion and Spectral Equalization, 1-P-6, pp. 349-350, Fujitsu Laboratories.

* cited by examiner

*Primary Examiner* — Vincent P Harper
(74) *Attorney, Agent, or Firm* — Holtz, Holtz, Goodman & Chick, PC

(57) ABSTRACT

A signal bandwidth extension apparatus includes a determination unit which determines whether or not a peak component of the input signal is lacked in the band to be extended, and a control unit which controls to extend the bandwidth when the determination unit determines that the peak component of the input signal is lacked in the band to be extended, and not to extend the bandwidth when the determination unit determines that the peak component is not lacked.

26 Claims, 23 Drawing Sheets

SIGNAL BANDWIDTH EXTENSION APPARATUS

CROSS-REFERENCE TO RELATED APPLICATIONS

This application is based upon and claims the benefit of priority from prior Japanese Patent Application No. 2008-222291, filed Aug. 29, 2008, the entire contents of which are incorporated herein by reference.

BACKGROUND OF THE INVENTION

1. Field of the Invention

The present invention relates to a signal bandwidth extension apparatus which converts a band-limited signal such as a speech signal, music signal, or audio signal into a wideband signal.

2. Description of the Related Art

As is well known, upon extending the bandwidth of a signal such as a speech signal, music signal, or audio signal (input signal) to a wideband signal, a bandwidth-extended signal (output signal) in a voiced sound has to maintain a structure (harmonic structure) in which a fundamental frequency and its overtones have peaks in a frequency domain and many components are present at frequency intervals of the fundamental frequency, so that the extended signal sounds like a natural sound in place of an artificial sound. Conventionally, the bandwidth extension method is roughly classified into a first method for generating a harmonic structure by extracting the fundamental frequency (for example, Jpn. Pat. Appln. KOKAI Publication No. 9-55778) and a second method for generating a harmonic structure by, e.g., nonlinear processing without extracting any fundamental frequency (for example, the Acoustical Society of Japan Transactions (October, 1994) "Telephone speech Enhancement by Bandwidth Expansion and Spectral Equalization", 1-P-6, pp. 349-350 (Fujitsu Laboratories Ltd.)).

The first method applies linear prediction analysis to an input signal to extract a fundamental frequency. Then, a linear prediction residual signal (excitation signal) is frequency-shifted by integer multiples of the fundamental frequency. The shifted signal is synthesized by a linear prediction synthesis filter, thus obtaining a bandwidth-extended signal. However, with this method, a heavy computational load is required to extract the fundamental frequency. Also, since there is no reliable extraction method of the fundamental frequency, unstable fundamental frequency extraction precision largely influences the overall sound quality.

On the other hand, the second method associated with the Acoustical Society of Japan Transactions (October, 1994) "Telephone speech Enhancement by Bandwidth Expansion and Spectral Equalization", 1-P-6, pp. 349-350 (Fujitsu Laboratories Ltd.) applies linear prediction analysis to an input signal, and applies nonlinear processing based on half-wave rectification to a linear prediction residual signal to extend a low-frequency bandwidth. Furthermore, a low-frequency bandwidth-extended signal is obtained by synthesis of a linear prediction synthesis filter. With this second method, although the computational load is light, a prediction signal which is not included in an actual sound (original sound) is generated, resulting in poor sound quality.

The conventional signal bandwidth extension apparatus requires a heavy computational load to extract the fundamental frequency or generates a prediction signal which is not included in an original sound, resulting in poor sound quality.

BRIEF SUMMARY OF THE INVENTION

The present invention has been made to solve the aforementioned problems, and has as its object to provide a signal bandwidth extension apparatus which can generate a bandwidth-extended signal which is more faithful to an original sound without requiring a heavy computational load.

In order to achieve the above object, according to the present invention, a signal bandwidth extension apparatus, which extends a bandwidth of an input signal, comprising: a determination unit which determines whether or not a peak component of the input signal is lacked in the band to be extended; and a control unit which controls to extend the bandwidth when the determination unit determines that the peak component of the input signal is lacked in the band to be extended, and not to extend the bandwidth when the determination unit determines that the peak component is not lacked. As described above, according to the present invention, whether or not a signal component in a band to be extended are lacked from an input signal is determined, a signal component in the band to be extended is synthesized based on the input signal according to this determination result, and the synthesized signal component is added to the input signal.

Therefore, according to the present invention, only when a signal in a band to be extended is lacked, the synthesized signal component is added. Hence, a signal bandwidth extension apparatus which can generate a bandwidth-extended signal which is more faithful to an original sound without requiring a heavy computational load can be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter with reference to the drawings.

Figure 1A:
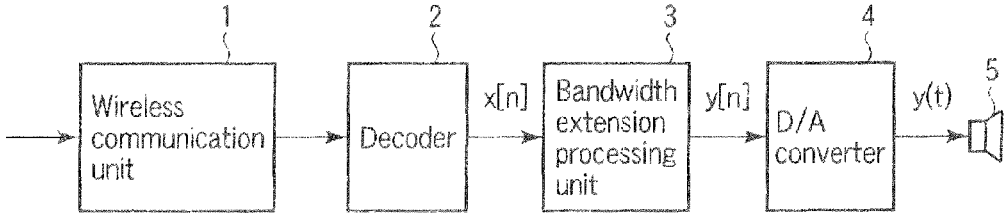
FIGS. 1A and 1B are block diagrams showing the arrangements of a communication apparatus and a digital audio player, to which a signal bandwidth extension apparatus according to the present invention is applied.

FIG. 1A shows the arrangement of a communication apparatus to which a signal bandwidth extension apparatus according to an embodiment of the present invention is applied. The communication apparatus shown in FIG. 1A corresponds to a receiving system of a wireless communication apparatus such as a cell phone, and includes a wireless communication unit 1, decoder 2, bandwidth extension processing unit 3, and D/A converter 4.

The wireless communication unit 1 wirelessly communicates with a wireless base station accommodated in a mobile communication network, and communicates with a communication partner station by establishing a communication link with that communication partner station via this wireless base station and mobile communication network.

The decoder 2 decodes reception data received by the wireless communication unit 1 from the communication partner station for each unit (1 frame=N samples), which is determined in advance to obtain digital input signal x[n] (n=0, 1, . . . , N−1). Assume that one frame includes N=160 samples. The input signal x[n] is narrowband signal which is band-limited at a sampling frequency fs [Hz] to a band from fs_nb_low [Hz] to fs_nb_high [Hz]. The digital input signal x[n] obtained in this way is output to the bandwidth extension processing unit 3 for each frame.

The bandwidth extension processing unit 3 applies bandwidth extension processing to the input signal x[n](n=0, 1, . . . , N−1) for each frame, and the bandwidth extension processing extends the input signal to a bandwidth from fs_wb_low [Hz] to fs_wb_high [Hz]. At this time, the sampling frequency remains unchanged as the sampling frequency fs [Hz] in the decoder 2, or is changed to a higher sampling frequency fs' [Hz]. That is, the bandwidth extension processing unit 3 obtains bandwidth-extended output signal y[n] at the sampling frequency fs [Hz] or fs' [Hz] for each frame. An example of the practical arrangement of the bandwidth extension processing unit 3 will be described later.

The D/A converter 4 converts the bandwidth-extended output signal y[n] into an analog signal y(t), and outputs the analog signal to a loudspeaker 5. The loudspeaker 5 outputs the output signal y(t) as an analog signal to an acoustic space.

Figure 1B:
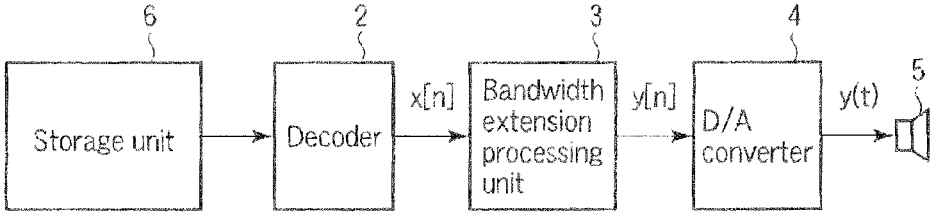

Note that the signal bandwidth extension apparatus according to the present invention is applied to the communication apparatus in FIG. 1A. Also, as shown in FIG. 1B, the signal bandwidth extension apparatus can be applied to a digital audio player. This digital audio player includes a storage unit 6 using a flash memory or HDD (Hard Disk Drive) in place of the wireless communication unit 1, and the decoder 2 decodes music data read out from this storage unit 6, as described above.

Embodiments of the bandwidth extension processing unit 3 will be described hereinafter.

[First Embodiment]

Figure 2:
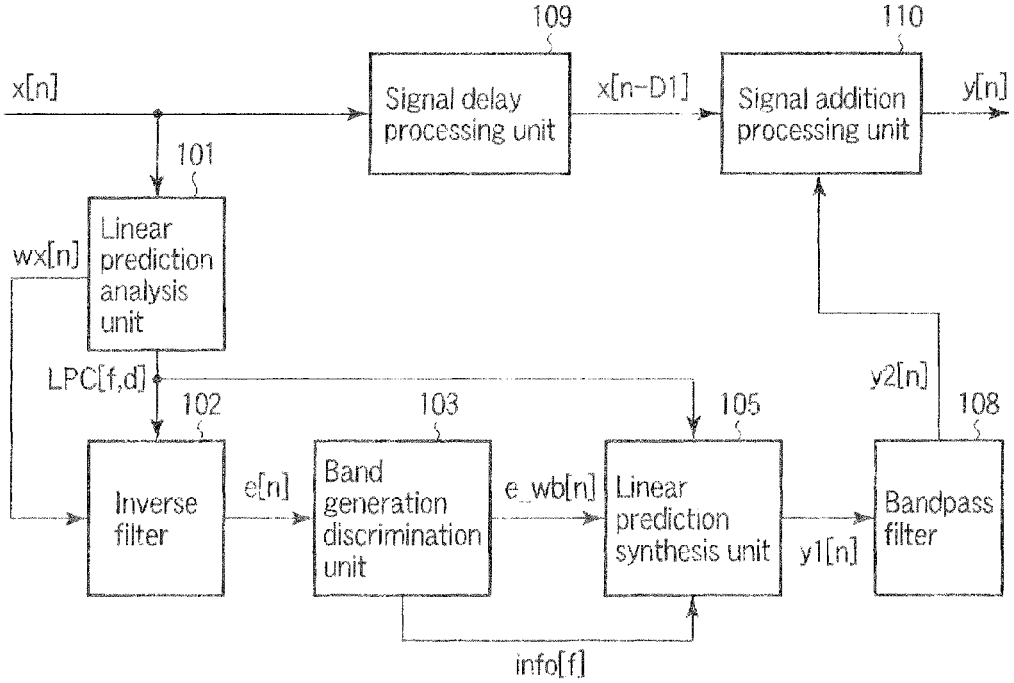
FIG. 2 is a block diagram showing the arrangement of the first embodiment of a signal bandwidth extension apparatus according to the present invention.

FIG. 2 shows the arrangement of the first embodiment of the bandwidth extension processing unit 3 according to the present invention. In the first embodiment, assume that the bandwidth extension processing of the bandwidth extension processing unit 3 extends signal to a band from fs_wb low [Hz] to fs_wb_high [Hz] while the sampling frequency fs [Hz] remains unchanged. Note that $fs_wb_low \leqq fs_nb_low < fs_nb_high \leqq fs_wb_high < fs/2$ is satisfied.

In the following description, since low-band extension will be exemplified, $fs_wb_low < fs_nb_low$ and $fs_nb_high = fs_wb_high$, and assume that, for example, fs=8000 [Hz], fs_nb_low=340 [Hz], fs_nb_high=3950 [Hz], fs_wb low=50 [Hz], and fs_wb_high=3950 [Hz]. The frequency bands of band limitations and the sampling frequency are not limited to such specific values.

As shown in FIG. 2, the bandwidth extension processing unit 3 of the first embodiment includes a linear prediction analysis unit 101, inverse filter 102, band generation discrimination unit 103, linear prediction synthesis unit 105, bandpass filter 108, signal delay processing unit 109, and signal addition processing unit 110. These units can also be implemented by one processor and software recorded in a storage medium (not shown).

The linear prediction analysis unit 101 receives input signal x[n] (n=0, 1, . . . , N−1) of a current frame f, which is band-limited to a narrowband. The linear prediction analysis unit 101 applies linear prediction analysis to these input signal to obtain linear prediction coefficients LPC[f,d] (d=1, . . . , Dn) of order Dn as narrowband spectral parameters that represent a narrowband spectral envelope. Note that, for example, Dn=14. More specifically, the linear prediction analysis unit 101 executes windowing of a data length 2N by multiplying input signal x[n] (n=0, 1, . . . , 2N−1) of the data length 2N obtained by coupling a total of two frames, i.e., the input signal x[n](n=0, 1, . . . , N−1) of the current frame and those of a frame immediately before the current frame by a hamming window as a window function. The linear prediction analysis unit 101 then applies linear prediction analysis of order Dn to signal wx[n] (n=0, 1, . . . , 2N−1) after windowing. Note that the input signal one frame before is held using a memory included in the linear prediction analysis unit 101.

In this case, assume that an overlap as a ratio of a shift width (N samples in this case) of input signal x[n] at the next time (frame) and a data length (2N samples in this case) of the input signal wx[n] that has undergone windowing is set to be 50%. However, the window function used in windowing is not limited to the hamming window, but it may be changed to other symmetric windows (a harm window, Blackman window, sine window, and the like) or asymmetric windows used in audio encoding processing as needed. The overlap is not limited to 50%. In the example of this embodiment, linear prediction coefficients are used as the narrowband spectral parameters which express the narrowband spectral envelope. Alternatively, line spectral pairs (LSP), line spectral frequencies (LSF), partial auto-correlation (PARCOR) coefficients, mel frequency cepstral coefficients, and the like may be used as narrowband spectral parameters.

The inverse filter 102 forms an inverse filter using the linear prediction coefficients LPC[f,d] obtained by the linear prediction analysis unit 101, and inputs the input signal wx[n] of the data length 2N which have undergone windowing by the linear prediction analysis unit 101 to that inverse filter, thereby obtaining linear prediction residual signal e[n] of the data length 2N as narrowband excitation signal.

The band generation discrimination unit 103 checks whether or not a peak component of an input signal is lacked in a band to be extended. That is, the band generation discrimination unit 103 checks if the fundamental frequency is lacked from the input signal. When it is determined that the fundamental frequency is not lacked, the band generation discrimination unit 103 operates not to use a signal whose low band is widebanded. On the other hand, if it is determined that the fundamental frequency is lacked from the input signal, the band generation discrimination unit 103 operates to use a signal whose low band is widebanded, since the fundamental frequency is restored by wideband processing of a low band. The band generation discrimination unit 103 receives the linear prediction residual signal e[n] as band-limited narrowband signal, and generates linear prediction residual signal e_wb[n] as widebanded excitation signal obtained by bandwidth-extending the low band of the received signal. Also, the band generation discrimination unit 103 generates control information info[f] indicating whether or not to execute band generation for each frame. This signal and information are output to the linear prediction synthesis unit 105.

Figure 3:
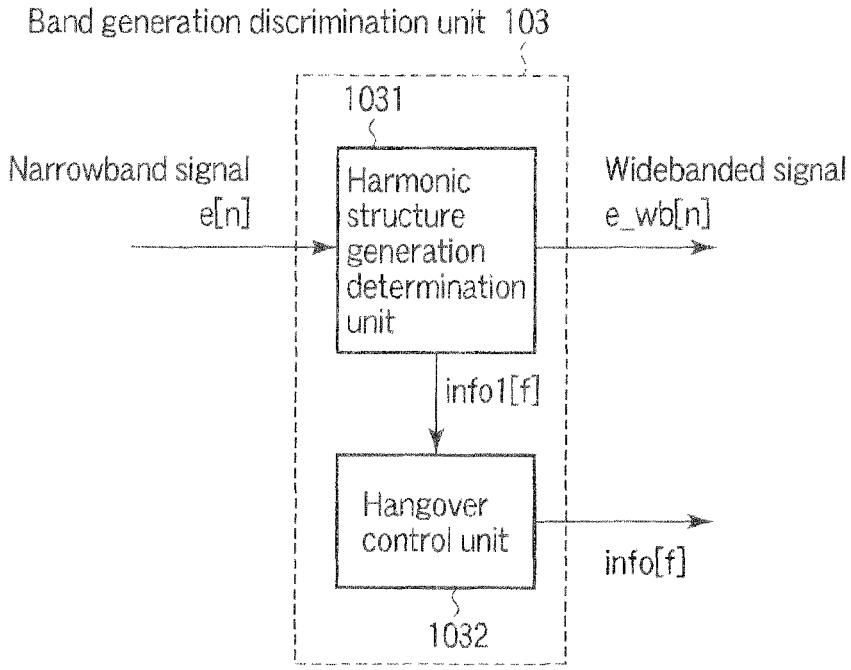
FIG. 3 is a block diagram showing an example of the arrangement of a band generation discrimination unit of the signal bandwidth extension apparatus shown in FIG. 2.

FIG. 3 shows an arrangement example of the band generation discrimination unit 103. In this arrangement example, the band generation discrimination unit 103 includes a harmonic structure generation determination unit 1031 and hangover control unit 1032.

Figure 4:
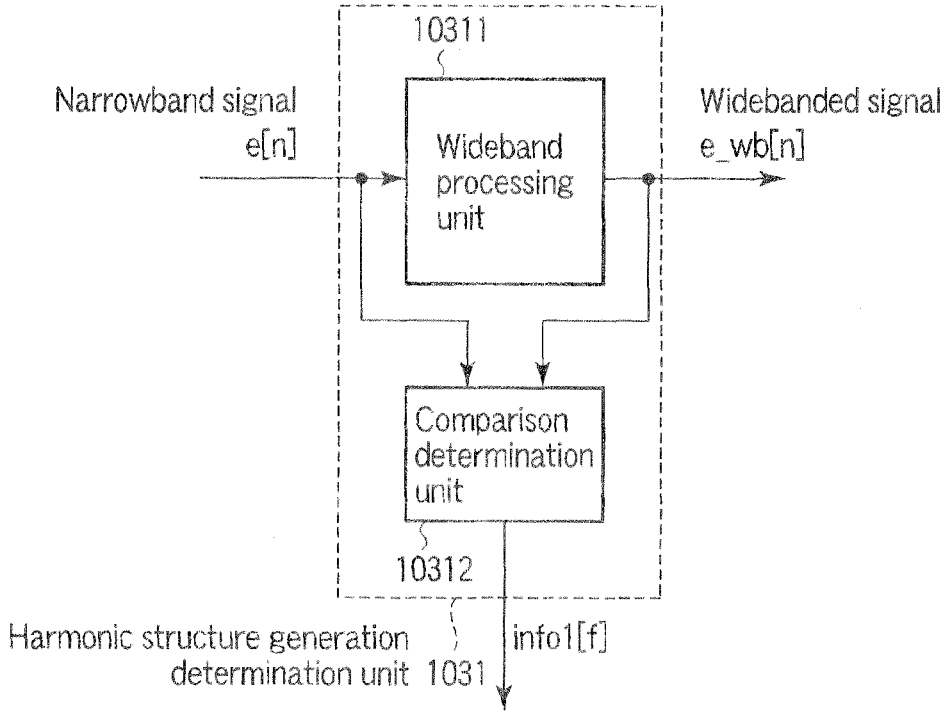
FIG. 4 is a block diagram showing an example of the arrangement of a harmonic structure generation determination unit shown in FIG. 3.

The harmonic structure generation determination unit 1031 includes a wideband processing unit 10311 and comparison determination unit 10312, as shown in FIG. 4.

The wideband processing unit 10311 applies nonlinear processing to the linear prediction residual signal e[n] of the data length 2N as the band-limited narrowband signal which is obtained by the inverse filter 102 so as to convert them into wideband signal having a structure (harmonic structure) which has peaks in the frequency domain for respective overtones of the fundamental frequency in a voiced sound. With this processing, widebanded linear prediction residual signal e_wb[n] of the data length 2N is obtained.

Figure 5A:
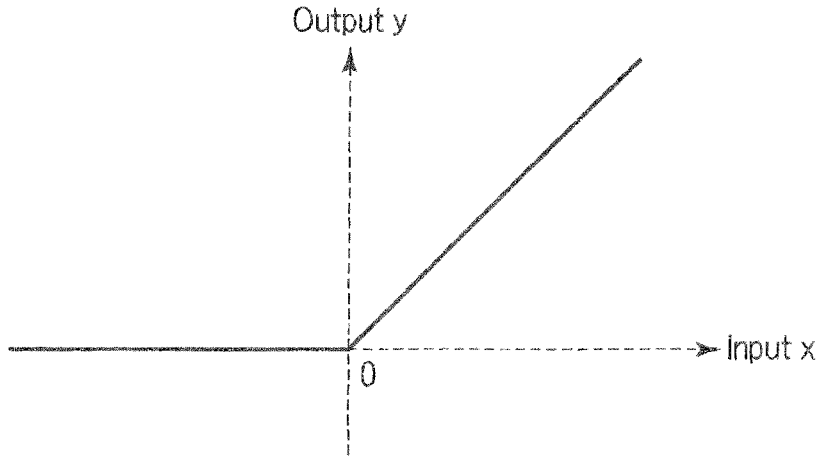
FIGS. 5A to 5C are graphs showing examples of nonlinear functions used in nonlinear processing of a wideband processing unit shown in FIG. 4.
Figure 5B:
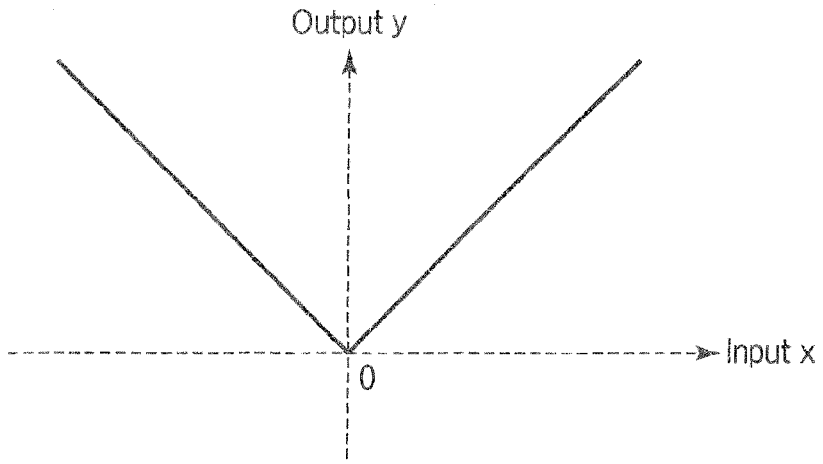
Figure 5C:
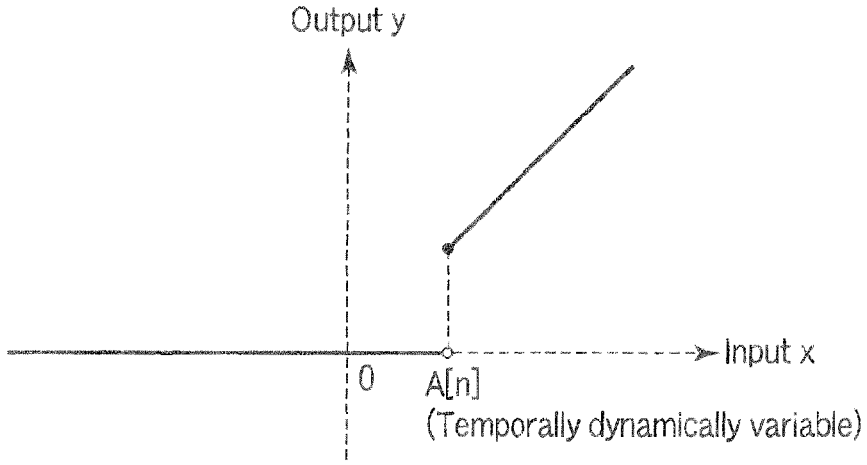

As examples of such nonlinear processing for converting into a harmonic structure, nonlinear processing using each of nonlinear functions shown in FIGS. 5A to 5C is available. FIG. 5A shows half-wave rectification. As the nonlinear processing for converting into the harmonic structure, full-way rectification can also be used, as shown in FIG. 5B. A[n] in FIG. 5C represents a temporally dynamically variable threshold obtained by calculating an average value of absolute values of amplitudes of the linear prediction residual signal e[n] in the time domain for each frame, and setting a value obtained by adding a constant value, which is set in advance, to the average value of the absolute values of the amplitudes. The present invention is not limited to these processes. However, it is desirable to use a function which leaves at least periodicity so as to generate the fundamental frequency when the fundamental frequency is lacked from band-limited input signal in a voiced sound due to this band limitation, and not to generate the fundamental frequency when the fundamental frequency is not lacked.

Figure 6:
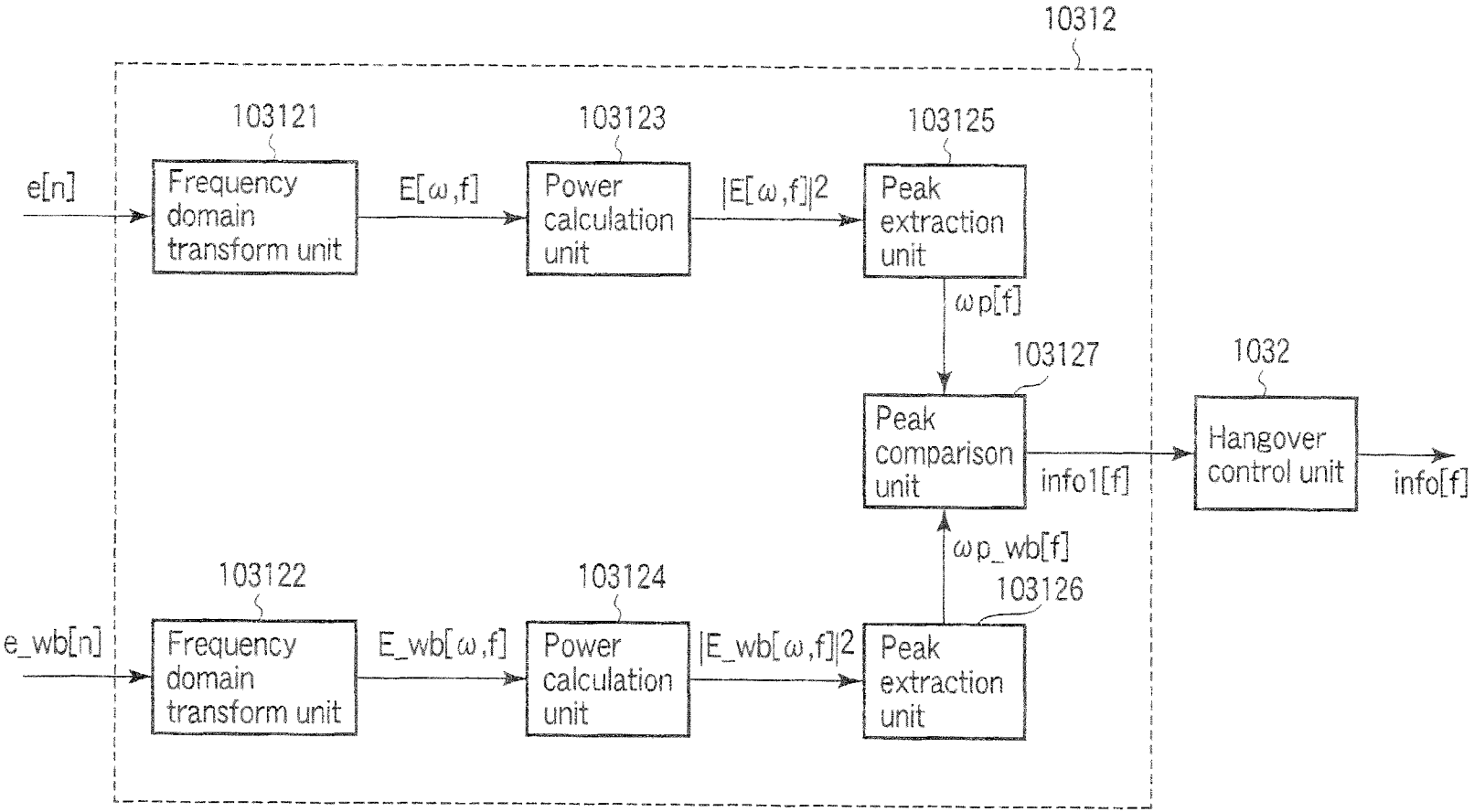
FIG. 6 is a block diagram showing an example of the arrangement of a comparison determination unit of the harmonic structure generation determination unit shown in FIG. 4.

The comparison determination unit 10312 compares the linear prediction residual signal e[n] of the data length 2N as the band-limited narrowband signal with the widebanded linear prediction residual signal e_wb[n] of the data length 2N to determine whether or not to use the harmonic structure generated by the wideband processing unit 10311, and outputs this determination result to the hangover control unit 1032 as determination information info1[f]. FIG. 6 shows an arrangement example of the comparison determination unit 10312.

The comparison determination unit 10312 shown in FIG. 6 includes frequency domain transform units 103121 and 103122, power calculation units 103123 and 103124, peak extraction units 103125 and 103126, and a peak comparison unit 103127.

The frequency domain transform unit 103121 receives the linear prediction residual signal e[n] of the data length 2N, and transforms this signal into those of the frequency domain by applying processing such as FFT (Fast Fourier Transform) to them, thereby calculating frequency spectra E[ω,f] of the linear prediction residual signal e[n]. In the following description, assume that the size of the FFT is 2N, ω represents index of the frequency bin, and $1 \leqq \omega \leqq 2N$. However, the size of the FFT is not limited to this. For example, signal to which the FFT is applied is zero-padded to convert the data length into the power of 2, so as to set the size of the FFT to be the power of 2.

Likewise, the frequency domain transform unit 103122 receives the linear prediction residual signal e_wb[n] of the data length 2N, and transforms this signal into those of the frequency domain by applying processing such as FFT to them, thereby calculating frequency spectra E_wb[ω,f] of the linear prediction residual signal e_wb[n]. Likewise, in the following description, assume that the size of the FFT is 2N.

Note that the frequency domain transform units 103121 and 103122 can alternatively use other orthogonal trans forms that transform signals into those of the frequency domain such as DFT (Discrete Fourier Transform), DCT (Discrete Cosine Transform), WHT (Walsh Hadamard Transform), HT (Harr Transform), SLT (Slant Transform), and KLT (Karhunen Loeve Transform).

The power calculation unit 103123 receives the frequency spectra E[ω,f] and calculates power spectra $|E[\omega,f]|^2$ based on the received spectra.

Likewise, the power calculation unit 103124 receives the frequency spectra E_wb[ω,f] and calculates power spectra $|E_wb[\omega,f]|^2$ based on the received spectra.

The peak extraction unit 103125 receives the power spectra $|E[\omega,f]|^2$, and searches, from a low frequency to a high frequency, a predetermined search range (equal to or higher than fs_nb_low and less than fs_serch1) that does not include at least a frequency band (equal to or higher than fs_wb_low [Hz] and less than fs_nb_low [Hz]) to be low-frequency bandwidth-extended, for a frequency (peak) at which the power spectrum $|E[\omega,f]|^2$ is local maximum and is equal to or larger than an average power spectrum $|E_avr[f]|^2$ over an entire frequency band, which is calculated in advance, based on the received spectra, thereby extracting a frequency ωp[f] [Hz] corresponding to a frequency bin of that peak. Note that fs_serch1 [Hz] is set in advance (for example, 500 [Hz] since the fundamental frequency of a human speech ranges from about 56 [Hz] to 500 [Hz]) or is dynamically set so as to capture the fundamental frequency in case of a voiced sound.

Likewise, the peak extraction unit 103126 receives the power spectra $|E_wb[\omega,f]|^2$, and searches, from a low frequency to a high frequency, a predetermined search range (equal to or higher than fs_wb_low [Hz] and less than fs_serch2 [Hz]) that includes at least a low-frequency bandwidth-extended frequency band (equal to or higher than fs_wb_low [Hz] and less than fs_serch2 [Hz]), for a frequency (peak) at which the power spectrum $|E_wb[\omega,f]|^2$ is local maximum and is equal to or larger than an average power spectrum $|E_wb\ avr[f]|^2$ over an entire frequency band, which is calculated in advance, based on the received spectra, thereby extracting a frequency ωp_wb[f] [Hz] corresponding to a frequency bin of that peak.

Note that fs_serch2 [Hz] is set in advance or is dynamically set so as to capture the fundamental frequency in case of a voiced sound. fs_serch2 may assume the same value as fs_serch1. In this case, a fixed value fs_serch1=fs_serch2=500 [Hz] is used.

The peak comparison unit 103127 executes determination processing as to whether or not the fundamental frequency is lacked from the input signal. In this determination processing, the peak comparison unit 103127 determines that a signal component which has a peak at the fundamental frequency lacked due to the band limitation is generated by the wideband processing of the wideband processing unit 10311 by confirming based on the frequencies ωp[f] [Hz] and ωp_wb [f] [Hz] that a peak at ωp_wb[f] [Hz] having a sufficiently larger power than a peak at ωp[f] [Hz] is generated in a frequency band lower than fs_nb_low [Hz], and the frequency of this peak is included in a frequency band which is set in advance. The peak comparison unit 103127 outputs determination information info1[f]="1" to the hangover control unit 1032 when it determines that a signal component having a peak at the fundamental frequency is generated, or outputs "0" when it does not determine that a signal component is generated. Since the wideband processing of the wideband processing unit 10311 generates a halftone (half frequency) of a minimum frequency at which the power spectrum $|E[\omega,f]|^2$ assumes a local maximal value in the power spectra $|E_wb[\omega,f]|^2$, the upper limit value of the frequency band which is set in advance is set to be about a half of fs_serch1, and the lower limit value is set to be about a half of fs_nb_low [Hz]. In this case, for example, the frequency band is set to range from 150 to 250 [Hz].

As a result, when the fundamental frequency is lacked from the input signal, for example, assuming that the frequency ωp[f] is an overtone (doubled frequency) of the fundamental frequency, the peak extraction unit 103125 extracts the frequency ωp[f] from the range from fs_nb_low [Hz] (inclusive) to fs_serch1 [Hz] (exclusive), the peak extraction unit 103126 extracts the frequency ωp_wb[f] as the halftone of the frequency ωp[f] generated by the wideband processing of the wideband processing unit 10311, and a peak with a sufficiently large power is generated in the predetermined frequency band (equal to or higher than about fs_nb_low÷2 [Hz] and less than fs_serch1÷2 [Hz]), thus determining the frequency ωp_wb[f] as the lacked fundamental frequency, and determining that the fundamental frequency is lacked from the input signal. On the other hand, when the fundamental frequency is not lacked from the input signal, for example, assuming that the frequency ωp[f] is the fundamental frequency, the peak extraction unit 103125 extracts the frequency ωp[f] from the range from fs_nb_low [Hz] (inclusive) to fs_serch1 [Hz](exclusive), and the wideband processing of the wideband processing unit 10311 generates a halftone of the frequency ωp[f], but a peak having a sufficiently large power is not generated in the predetermined range (equal to or higher than about fs_nb_low÷2 [Hz] and less than fs_serch1÷2 [Hz]). Hence, the peak extraction unit 103126 does not extract any frequency ωp_wb[f], and it is determined that the fundamental frequency is not lacked from the input signal.

With this processing, since a case in which the fundamental frequency is lacked from the input signal and that in which it is not lacked can be discriminated with a light computational load without explicitly extracting the fundamental frequency, a signal more faithful to an original sound can be generated according to the respective cases.

That is, when the comparison determination unit 10312 confirms based on the linear prediction residual signal e[n] of the data length 2N as band-limited narrowband signal and the wideband linear prediction residual signal e_wb[n] of the data length 2N that (1) peaks of different frequencies are generated in the low-frequency range before and after the wideband processing of the wideband processing unit 10311, (2) these peaks exceed the average level of the entire frequency band, and (3) the peak after the wideband processing exists in the fundamental frequency range, it outputs the determination information info1[f]="1" to the hangover control unit 1032.

A practical example of the comparison determination unit 10312 with the above arrangement will be described below.

Figure 7A:
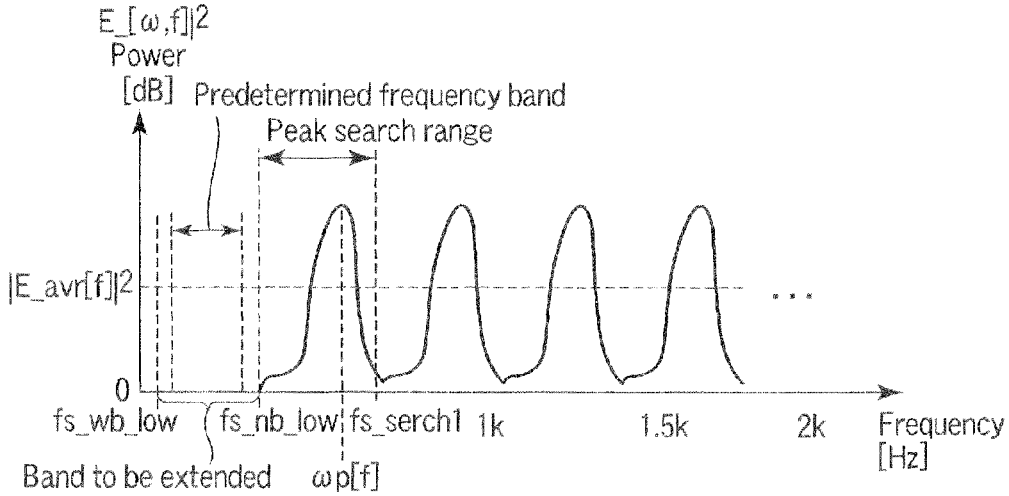
FIGS. 7A to 7C are input/output signal waveform charts for explaining the operation of the signal bandwidth extension apparatus shown in FIG. 2.

A case will be explained first wherein, for example, a speech which has a low voice pitch to have the fundamental frequency in a band equal to or lower than fs_nb_low [Hz]

and in which the fundamental frequency is lacked is input as input signal like a male speech. The operation of the comparison determination unit 10312 in this case will be described below with reference to FIGS. 7A to 7C. In this case, the peak extraction unit 103125 receives power spectra $|E[\omega,f]|^2$ shown in FIG. 7A. Then, the peak extraction unit 103125 conducts a peak search in turn from a low frequency in a frequency band equal to or higher than fs_nb_low [Hz] and less than fs_serch1 [Hz], thereby extracting a frequency ωp[f] [Hz] corresponding to a frequency bin of a peak which is equal to or higher than an average power spectrum $|E_avr[f]|^2$ in an entire frequency band, which is calculated in advance.

Figure 7B:
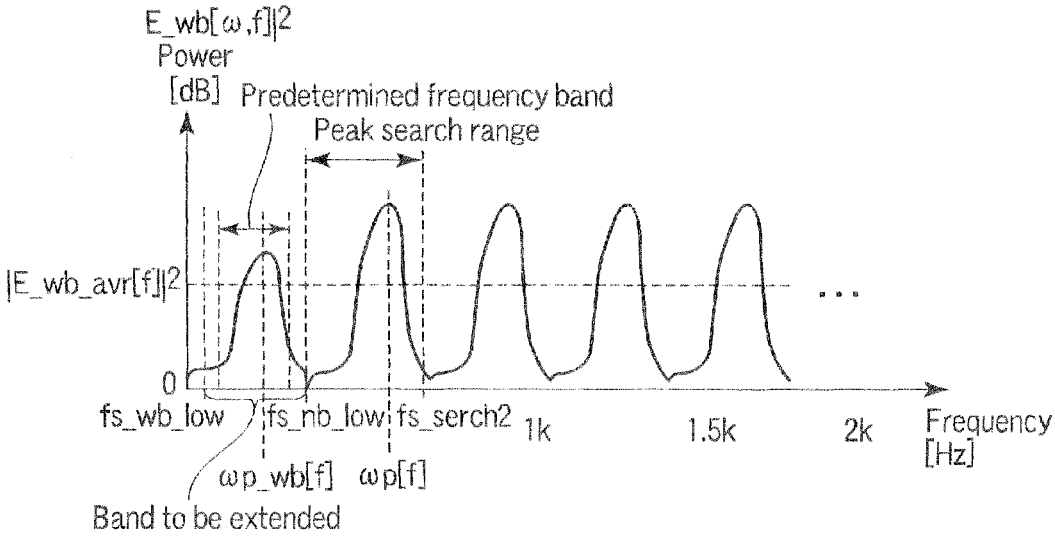

The peak extraction unit 103126 receives power spectra $|E_wb[\omega,f]|^2$ shown in FIG. 7B. Then, the peak extraction unit 103126 conducts a peak search in turn from a low frequency in a frequency band equal to or higher than fs_wb_low [Hz] and less than fs_serch2 [Hz], thereby extracting a frequency ωp_wb[f] [Hz] corresponding to a frequency bin of a peak which is equal to or higher than an average power spectrum $|E_wb_avr[f]|^2$ in the entire frequency range, which is calculated in advance.

Figure 7C:
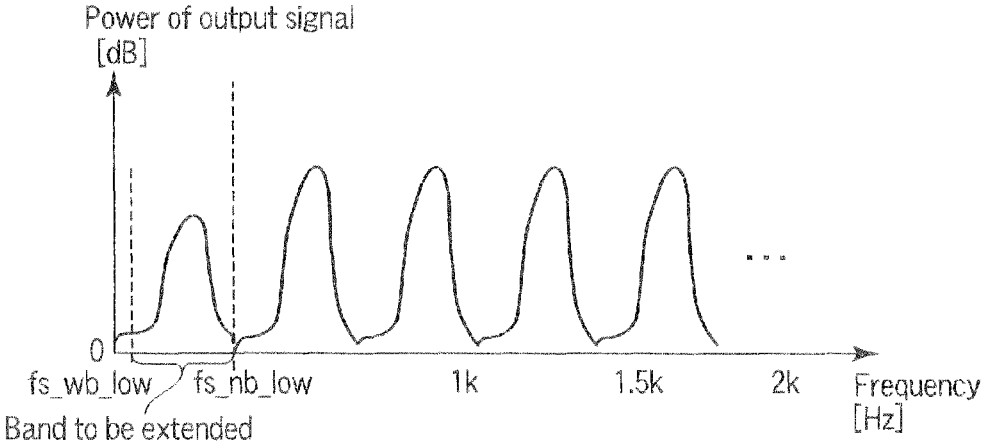

The peak comparison unit 103127 confirms that the frequency ωp[f] extracted by the peak extraction unit 103125 does not match the frequency ωp_wb[f] extracted by the peak extraction unit 103126, and also confirms that the frequency ωp_wb[f] is included in the aforementioned predetermined frequency band (e.g., 150 to 250 [Hz]), which is set in advance. As a result, the peak comparison unit 103127 determines that the fundamental frequency is lacked from the input signal, and outputs determination information info1[f]="1" to the hangover control unit 1032, so as to operate to use the linear prediction residual signal e_wb[n] of the data length 2N as signal whose low-frequency band undergoes bandwidth extension by the wideband processing of the wideband processing unit 103, as shown in FIG. 7C.

Figure 8A:
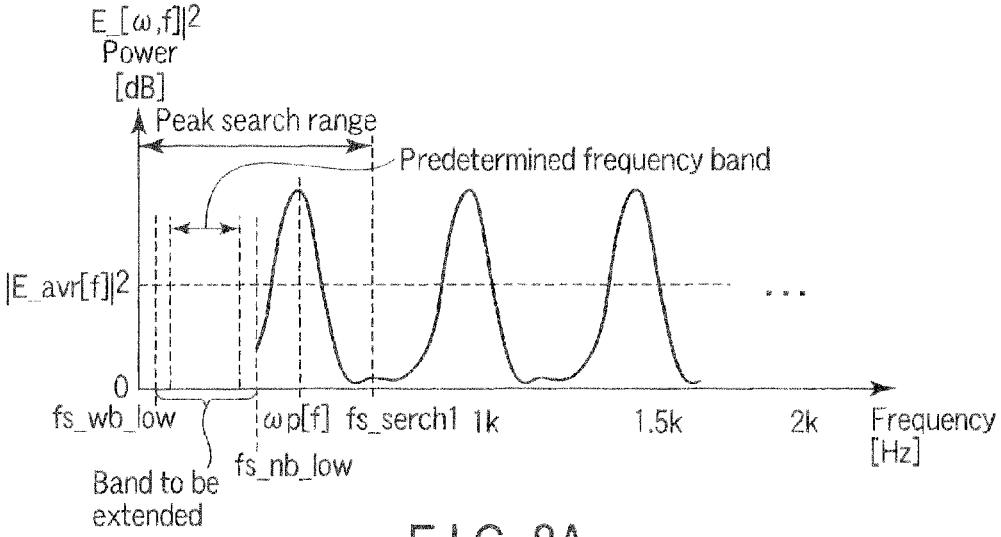
FIGS. 8A to 8C are input/output signal waveform charts for explaining the operation of the signal bandwidth extension apparatus shown in FIG. 2.

As the next example, a case will be explained below wherein, for example, a speech which has a high voice pitch to have the fundamental frequency in a band equal to or higher than fs_nb_low [Hz] and in which the fundamental frequency is not lacked is input as input signal like a female speech. The operation of the comparison determination unit 10312 in this case will be described below with reference to FIGS. 8A to 8C. In this case, the peak extraction unit 103125 receives power spectra $|E[\omega,f]|^2$, as shown in FIG. 8A. Then, the peak extraction unit 103125 conducts a peak search in turn from a low frequency in a frequency band equal to or higher than fs_nb_low [Hz] and less than fs_serch1 [Hz], thereby extracting a frequency ωp[f][Hz] corresponding to a frequency bin of a peak which is equal to or higher than an average power spectrum $|E_avr[f]|^2$ of the entire frequency band, which is calculated in advance.

Figure 8B:
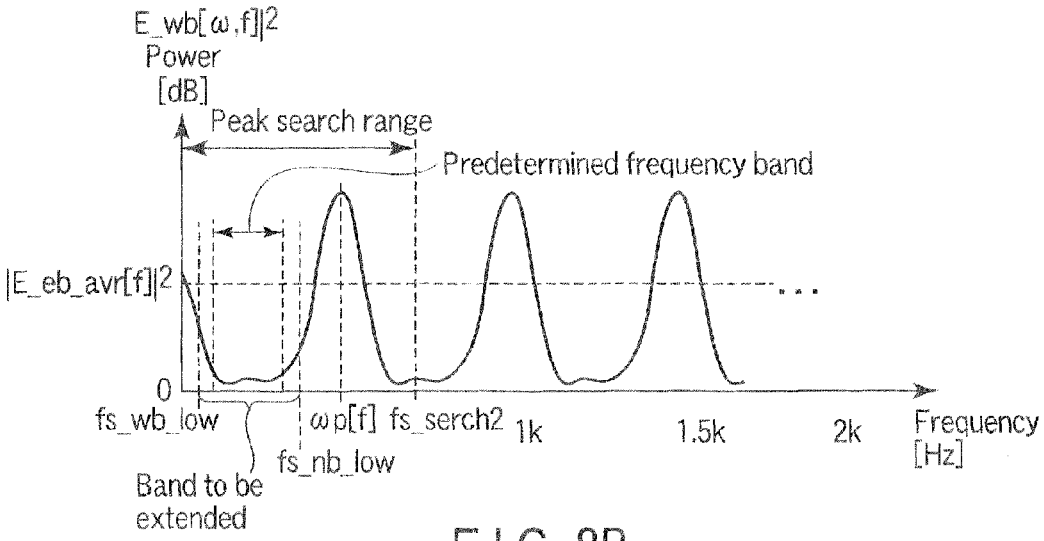

The peak extraction unit 103126 receives power spectra $|E_wb[\omega,f]|^2$, as shown in FIG. 8B. Then, the peak extraction unit 103126 conducts a peak search in turn from a low frequency in a frequency band equal to or higher than fs_wb_low [Hz] and less than fs_serch2 [Hz], thereby extracting a frequency ωp[f] [Hz]corresponding to a frequency bin of a peak which is equal to or higher than an average power spectrum $|E_wb_avr[f]|^2$ of the entire frequency band, which is calculated in advance. Note that the wideband processing of the wideband processing unit 10311 generates a halftone component of the frequency ωp[f] corresponding to the frequency bin of the peak at 0 [Hz], which is not extracted as the frequency bin of the peak.

Figure 8C:
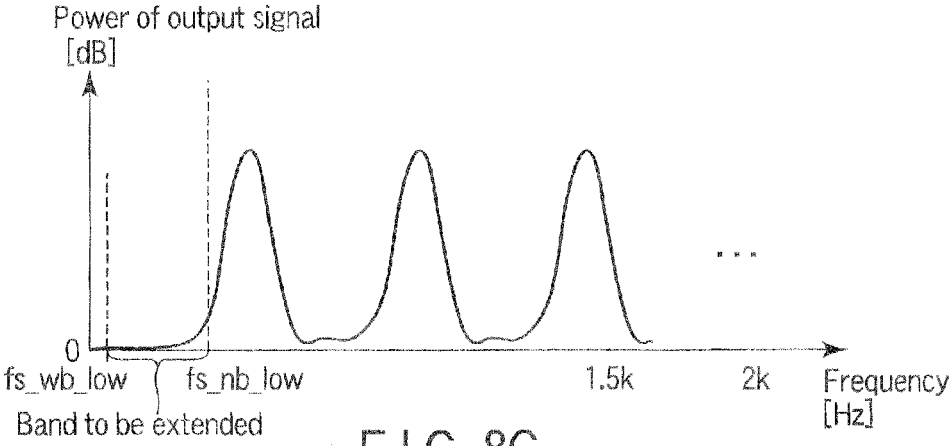

For this reason, the peak comparison unit 103127 cannot confirm that the frequency ωp[f] extracted by the peak extraction unit 103125 matches the output from the peak extraction unit 103126, and the frequency output from the peak extraction unit 103126 is included in the fundamental frequency band (e.g., 150 to 250 [Hz]). Then, the peak comparison unit 103127 determines that the fundamental frequency is not lacked from the input signal, and outputs determination information info1[f]="0" to the hangover control unit 1032 so as to operate to use the linear prediction residual signal e[n] of the data length 2N as signal whose low-frequency band does not undergo bandwidth extension by the wideband processing of the wideband processing unit 10311, as shown in FIG. 8C.

In this way, since a speech having a high or low voice pitch or implicitly a male or female speech can be discriminated with a light computational load without explicitly extracting the fundamental frequency, a signal more faithful to an original sound can be generated according to respective cases.

The hangover control unit 1032 levels pieces of determination information info1[f] from the harmonic structure generation determination unit 1031 (the comparison determination unit 10312) and outputs the leveled determination information as control information info[f] to a order/coefficient setting unit 1051. Since execution/non-execution of the band generation processing based on the determination information info1[f] is consequently determined for only each frame of a voiced sound, a determination result changes based on an unvoiced sound in one utterance, thus producing abnormal noise. Therefore, this leveling is done so as to prevent execution/non-execution of the band generation processing from being switched for respective frames in one utterance, and control information info[f]="1" or "0" is output based on pieces of control information info[f] obtained for a plurality of previous successive frames.

More specifically, the hangover control unit 1032 executes the following leveling processing.

Initially, the hangover control unit 1032 calculates sum_flag[f] by cumulatively summing pieces of control information info[f] for respective frames as follows.

When info1[f]=1, sum_flag[f]=sum_flag[f]+1

When info1[f]=0, sum_flag[f]=sum_flag[f]−1

Next, in order to allow agile detection at an anlaut, the hangover control unit 1032 controls a lower limit of sum_flag [f] as follows.

When sum_flag[f]<−3, sum_flag[f]=−3

Then, the hangover control unit 1032 inverts an isolation flag as follows so as to prevent frequent switching for respective frames.

When info1[f]=1 and sum_flag[f]<0, info1[f]=0

When info1[f]=0 and sum_flag[f]> 0, info1[f]=1

The hangover control unit 1032 outputs info1[f] which is hangover-controlled in this way as info[f]=info1[f].

Figure 9:
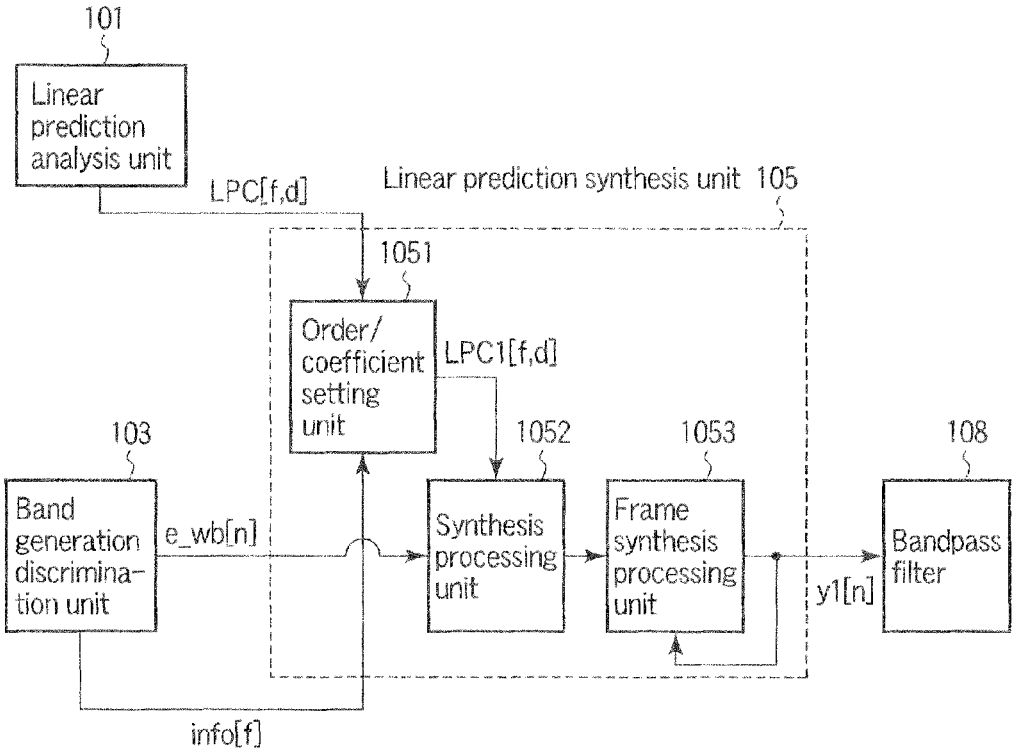
FIG. 9 is a block diagram showing an example of the arrangement of a linear prediction synthesis unit of the signal bandwidth extension apparatus shown in FIG. 2.

The linear prediction synthesis unit 105 includes a order/coefficient setting unit 1051, synthesis processing unit 1052, and frame synthesis processing unit 1053, as shown in FIG. 9, and generates first wideband signal y1[n] of the data length N based on the linear prediction coefficients LPC[f,d] as the narrowband spectral parameters, the linear prediction residual signal e_wb[n] of the data length 2N, and control information info[f]. When it is determined that the fundamental frequency is not lacked from the input signal (control information info[f]=0), the linear prediction synthesis unit 105 operates not to use the linear prediction residual signal e_wb[n] of the data length 2N, since a signal faithful to an original sound cannon be generated when the linear prediction residual signal e_wb[n] of the data length 2N as the wideband excitation signal generated by the wideband processing of the wideband processing unit 10311 is used. On the other hand, when it is determined that the fundamental frequency is lacked from the input signal (control information info[f]=1), the linear prediction synthesis unit 105 operates to use the linear prediction residual signal e_wb[n] of the data length 2N as the wideband excitation signal generated by the wideband processing of the wideband processing unit 10311. With this control, processing that can generate the fundamental frequency when the fundamental frequency is lacked from the input signal can be executed or processing that does not generate any signals when the fundamental frequency is not lacked from the input signal can be executed with a light computational load without explicitly extracting the fundamental frequency, thereby generating a signal more faithful to an original sound.

More specifically, when info[f]=1 is notified from the hangover control unit 1032 in the band generation discrimination unit 103, the order/coefficient setting unit 1051 sets the linear prediction coefficients LPC[f,d], which are the narrowband spectral parameters, as linear prediction coefficients LPC1[f,d], which are wideband spectral parameters, intact, and then generates a linear prediction synthesis filter using the linear prediction coefficients LPC1[f,d]. The synthesis processing unit 1052 applies linear prediction synthesis to the linear prediction residual signal e_wb[n] as wideband excitation signal using the linear prediction synthesis filter to output first wideband signal y1[n] of the data length 2N. The frame synthesis processing unit 1053 calculates first wideband signal y1[n] of the data length N by adding temporally former half data (data length N) of the first wideband signal y1[n] of the data length 2N and temporally latter half data (data length N) of those which were output from the linear prediction synthesis unit 105 one frame before in consideration of their overlap components.

On the other hand, when info[f]=0 is notified from the hangover control unit 1032 in the band generation discrimination unit 103, the order/coefficient setting unit 1051 generates linear prediction coefficients LPC1[f,d] in which LPC1[f,d]=0 is set for all "d"s, and generates a linear prediction synthesis filter using the linear prediction coefficients LPC1[f,d] as wideband spectral parameters. The synthesis processing unit 1052 applies linear prediction synthesis to the linear prediction residual signal e_wb[n] as wideband excitation signal using the linear prediction synthesis filter to output first, wideband signal y1[n] of the data length 2N. The frame synthesis processing unit 1053 calculates first wideband signal y1[n] of the data length N by adding temporally former half data (data length N) of the first wideband signal y1[n] of the data length 2N and temporally latter half data (data length N) of those which were output from the linear prediction synthesis unit 105 one frame before in consideration of their overlap components. Alternatively, when info[f]-0 is notified, the synthesis processing unit 1052 may set y1[n]=0 for all "n"s.

The bandpass filter 108 applies filter processing that allows to pass only signal of a frequency band to be extended to the wideband signal y1[n] of the data length N, and outputs the passed signal, i.e., those of the frequency band to be extended as second wideband signal y2[n] of the data length N. That is, the bandpass filter processing allows signal to pass through the frequency band from fs_wb_low [Hz] to fs_nb_low [Hz], and signal of this frequency band is obtained as the second wideband signal y2[n].

The signal delay processing unit 109 buffers the input signal x[n] of the data length N for a predetermined period of time (for D1 samples), and delays and outputs them as input signal x[n−D1], thus adjusting the timings to that of the signal output from the bandpass filter 108. That is, the predetermined period of time (for D1 samples) corresponds to a processing delay time period from the input to the linear prediction analysis unit 101 until the output is obtained from the bandpass filter 108. This value is calculated in advance, and D1 is always used as a fixed value.

The signal addition processing unit 110 adds the input signal x[n−D1] of the data length N output from the signal delay processing unit 109, and the second wideband signal y2[n] of the data length N without changing the sampling frequency fs [Hz] to obtain wideband signal y[n] of the data length N as output signal. Then, the input signal x[n−D1] is bandwidth-extended by the second wideband signal y2[n].

As described above, the signal bandwidth extension apparatus with the above arrangement applies low-frequency bandwidth extension processing as bandwidth extension processing with respect to an input signal, and determines whether or not a fundamental frequency component is lacked from the input signal by comparing signals before and after the bandwidth extension processing. When the fundamental frequency component: is lacked from the input signal, the apparatus adds a signal component generated by the bandwidth extension processing to the input signal to extend a bandwidth. When a signal of the fundamental frequency is not lacked from the input signal, the apparatus does not add any signal component generated by the bandwidth extension processing.

Therefore, according to the signal bandwidth extension apparatus with the above arrangement, a fundamental frequency component can be added to the input signal in which the fundamental frequency component is lacked due to the band limitation, and a halftone component of the fundamental frequency generated by the bandwidth extension processing is inhibited from being added to the input signal in which the fundamental frequency is not lacked. Thus, a bandwidth-extended signal which is more faithful to an original sound and has good sound quality can be generated. Since the computational load in the band generation discrimination unit 103 is light, a heavy computational load required for signal processing can be avoided.

In the arrangement of this embodiment, only the input signal x[n] are input from the decoder 2 to the bandwidth extension processing unit 3. Alternatively, pieces of information obtained by the decoder 2, for example, linear prediction coefficients LPC[f,d], linear prediction residual signal e[n], and the like may be used in the bandwidth extension processing unit 3. In this way, the need for modules required to calculate respective signals can be obviated, and the computational load can be further reduced.

(Modification 1 of First Embodiment)

Figure 10:
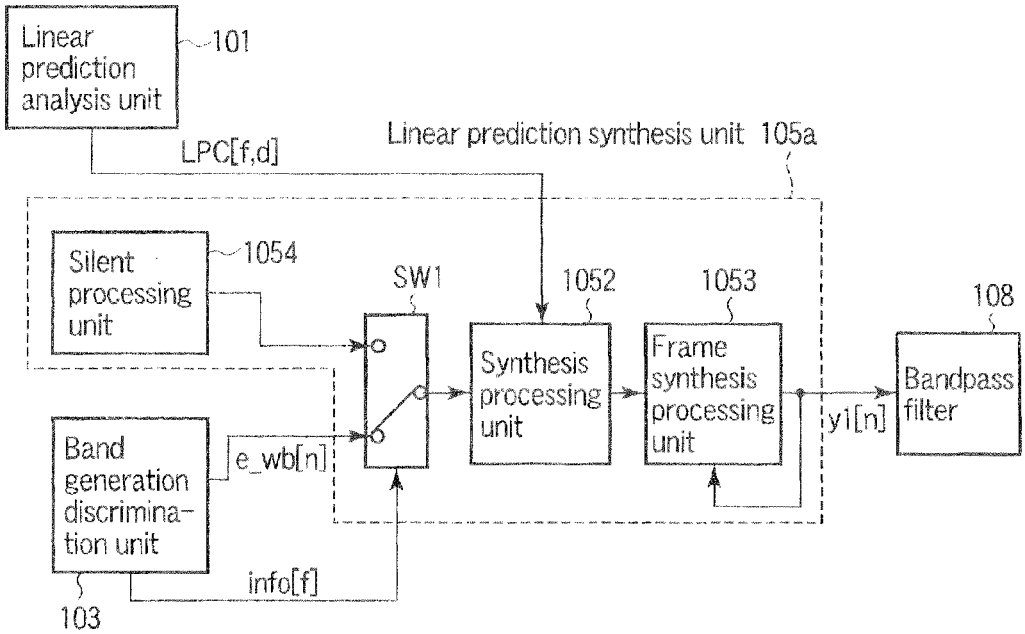
FIG. 10 is a block diagram showing a modification of the linear prediction synthesis unit of the signal bandwidth extension apparatus shown in FIG. 2.

A linear prediction synthesis unit 105*a* shown in FIG. 10 may be used in place of the linear prediction synthesis unit 105. The linear prediction synthesis unit 105*a* includes a silent processing unit 1054, changeover switch SW1, and synthesis processing unit 1052.

The changeover switch SW1 is changeover-controlled according to control information info[f], which is obtained by the band generation discrimination unit 103 and indicates whether or not to execute band generation. When band generation is to be executed, i.e., when the control information info[f]=1, the changeover switch SW1 outputs linear prediction residual signal e_wb[n] as wideband excitation signal generated by the band generation discrimination unit 103 (wideband processing unit 10311) to the synthesis processing unit 1052. On the other hand, when band generation is not to be executed, i.e., when the control information info[f]=0, the changeover switch SW1 outputs a silent signal generated by the silent processing unit 1054 to the synthesis processing unit 1052.

Then, the synthesis processing unit 1052 sets the linear prediction coefficients LPC[f,d], which are the narrowband spectral parameters, as wideband spectral parameters intact, and generates a linear prediction synthesis filter based on these wideband spectral parameters. The synthesis processing unit 1052 then applies linear prediction synthesis to the wideband excitation signal output from the changeover switch SW1, thus calculating first wideband signal y1[n] of the data length 2N.

With this arrangement as well, the same effects can be obtained.

According to this arrangement, since the linear prediction synthesis filter generated by the synthesis processing unit 1052 in the linear prediction synthesis unit 105 is always active, abnormal noise can be prevented from being generated due to discontinuous first wideband signal y1[n] as outputs when the Internal state of the linear prediction synthesis filter generated by the synthesis processing unit 1052 in the linear prediction synthesis unit 105 based on the linear prediction coefficients LPC[f,d] is influenced upon switching of the control information info[f] between 0 and 1.

(Modification 2 of First Embodiment)

Figure 11:
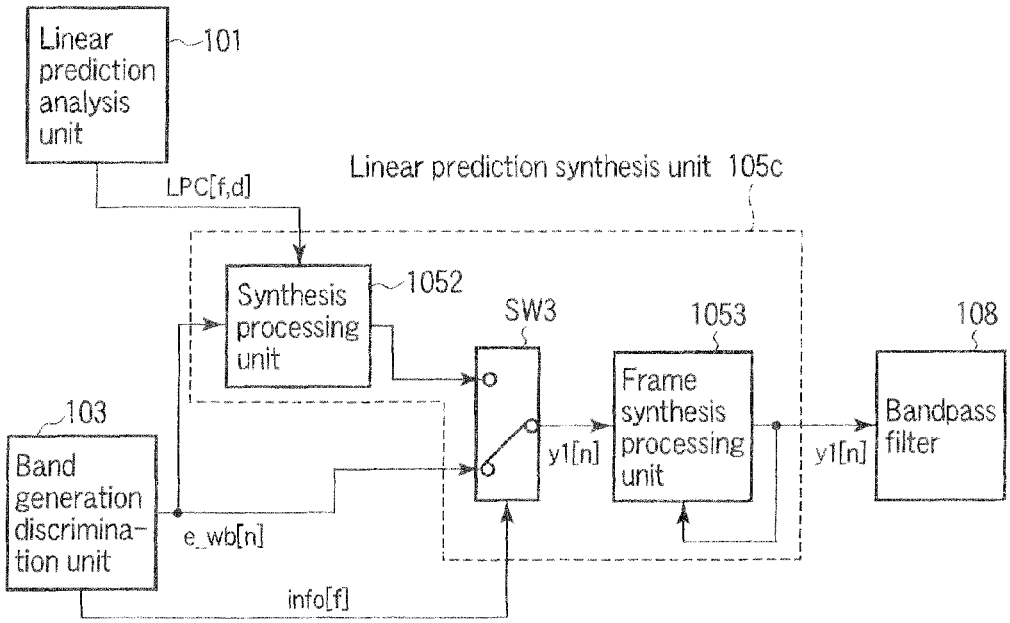
FIG. 11 is a block diagram showing another modification of the linear prediction synthesis unit of the signal bandwidth extension apparatus shown in FIG. 2.

A linear prediction synthesis unit 105*c* shown in FIG. 11 may be used in place of the linear prediction synthesis unit 105. The linear prediction synthesis unit 105*c* includes a changeover switch SW3, synthesis processing unit 1052, and frame synthesis processing unit 1053.

The changeover switch SW3 is changeover-controlled according to control information info[f], which is obtained by the band generation discrimination unit 103 and indicates whether or not to execute band generation. When band generation is to be executed, i.e., when the control information info[f]=1, the changeover switch SW3 outputs first wideband signal y1[n] of the data length 2N generated by the synthesis processing unit 1052 to the frame synthesis processing unit 1053. On the other hand, when band generation is not to be executed, i.e., when the control information info[f]=0, the changeover switch SW3 outputs linear prediction residual, signal e_wb[n] as wideband excitation signal generated by the band generation discrimination unit 103 (wideband processing unit 10311) as first wideband signal y1[n] to the frame synthesis processing unit 1053.

Then, the frame synthesis processing unit 1053 applies frame synthesis processing to the first wideband signal y1[n] of the data length 2N, which is output via the changeover switch SW3, thus calculating first wideband signal y1[n] of the data length N.

With this arrangement as well, the same effects can be obtained. Also, according to this arrangement, when the control information info[f]=0, since the linear prediction residual signal e_wb[n] generated by the band generation discrimination unit 103 are output, to the frame synthesis processing unit 1053 as the first wideband signal y1[n], the processing in the synthesis processing unit 1052 can be skipped. Hence, a bandwidth-extended signal which is more faithful to an original sound and has good sound quality can be generated with a lighter computational load than the first embodiment.

(Second Embodiment)

Figure 12:
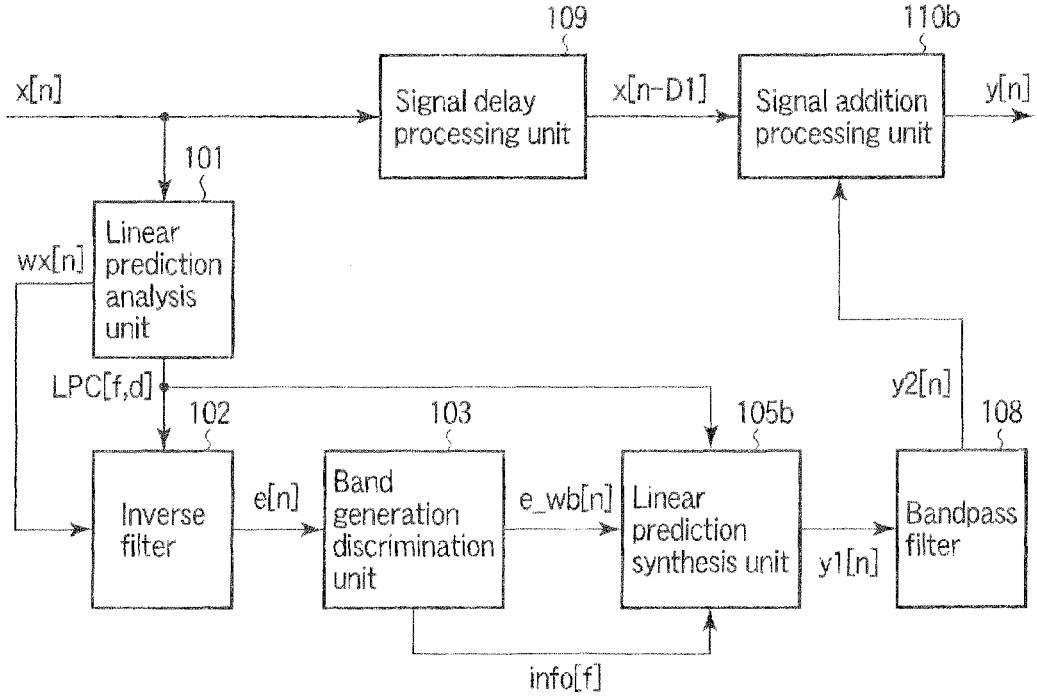
FIG. 12 is a block diagram showing an example of the arrangement of the second embodiment, of a signal bandwidth extension apparatus according to the present invention.

The second embodiment of the bandwidth extension processing unit 3 according to the present invention will be described below. FIG. 12 shows the arrangement of the bandwidth extension processing unit 3 of this embodiment. In the following description, the same reference numerals denote the same components as in the aforementioned first embodiment, and a repetitive description thereof will be avoided as needed for the sake of simplicity.

The bandwidth extension processing unit 3 according to the second embodiment uses a linear prediction synthesis unit 105*b* and signal addition processing unit 110*b* in place of the linear prediction synthesis unit 105 and signal addition processing unit 110 used in the bandwidth extension processing unit 3 according to the first embodiment.

The linear prediction synthesis unit 105*b* sets the linear prediction coefficients LPC[f,d], which are the narrowband spectral parameters, as wideband spectral parameters intact, and generates a linear prediction synthesis filter based on these wideband spectral parameters. The linear prediction synthesis unit 105*b* then applies linear prediction synthesis to linear prediction residual signal e_wb[n] as wideband excitation signal, and executes frame synthesis of these signals, thus calculating first wideband signal y1[n] of a data length N.

Figure 13:
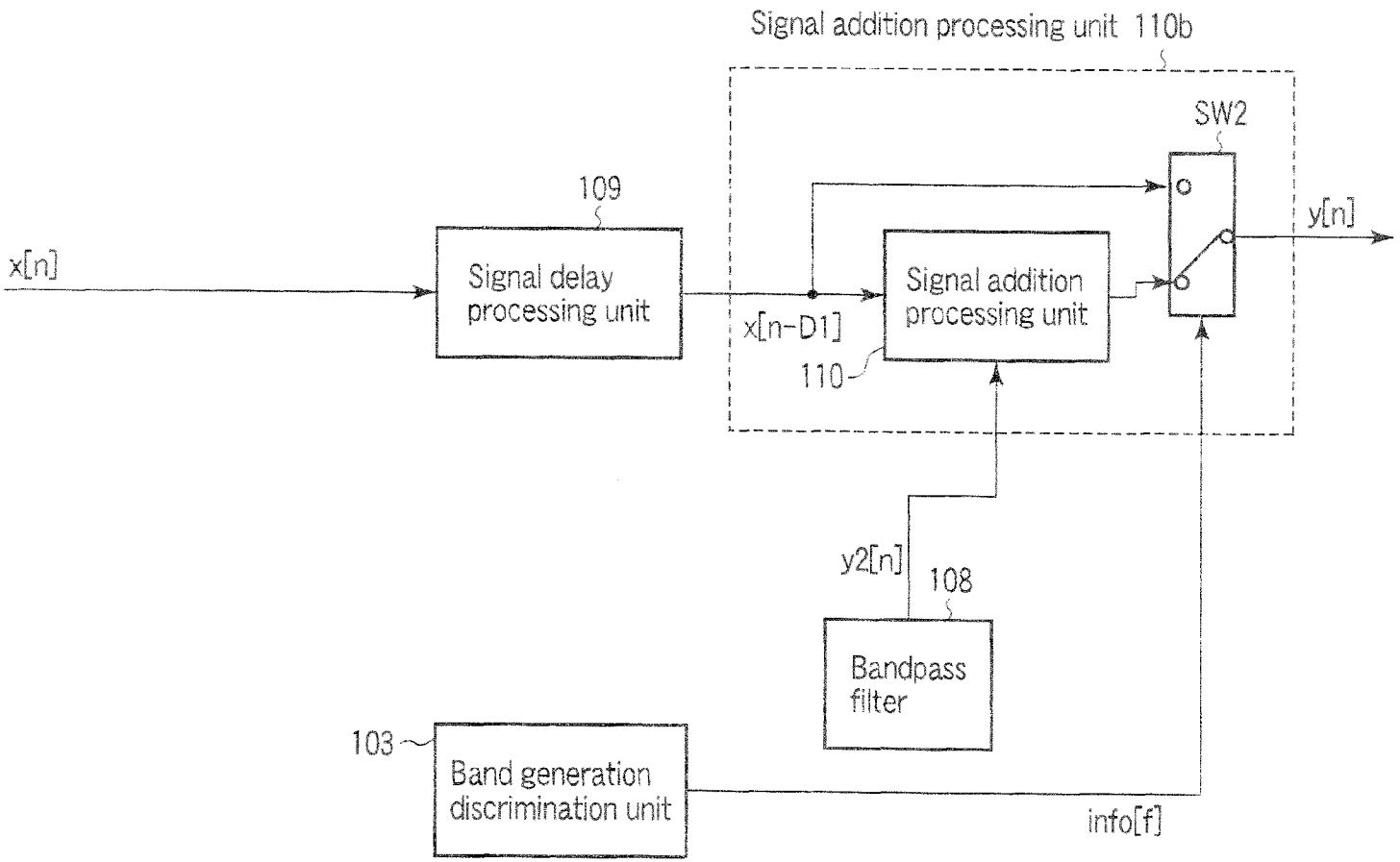
FIG. 13 is a block diagram showing an example of the arrangement of a signal addition processing unit of the signal bandwidth extension apparatus shown in FIG. 12.

The signal addition processing unit 110*b* has an arrangement, as shown in FIG. 13. That is, the signal addition processing unit 110*b* includes a signal addition processing unit 110 and changeover switch SW2.

The signal addition processing unit 110 adds input signal x[n−D1] of the data length N output from the signal delay processing unit 109 and second wideband signal y2[n] of the data length N without changing a sampling frequency fs [Hz] to obtain wideband signal y[n] of the data length N.

The changeover switch SW2 is changeover-controlled according to control information info[f], which is obtained by the band generation discrimination unit 103 and indicates whether or not to execute band generation. When band generation is to be executed, i.e., when the control information info[f]=1, the changeover switch SW2 outputs the wideband signal y[n] obtained by the signal addition processing unit 110 as output signal. On the other hand, when band generation is not to be executed, i.e., when the control information info[f]=0, the changeover switch SW2 output the input signal x[n−D1] of the data length N output from the signal delay processing unit 109.

With this arrangement as well, the same effects as in the first embodiment can be obtained. According to this arrangement, when the control information info[f]=0, since the input, signal x[n−D1] of the data length M output from the signal delay processing unit 109 is output as output signal, the processes of the linear prediction synthesis unit 105*b*, bandpass filter 108, and signal addition processing unit 110*b* can be skipped. Hence, a bandwidth-extended signal which is more faithful to an original sound and has good sound quality can be generated with a lighter computational load than the first embodiment.

(Third Embodiment)

Figure 14:
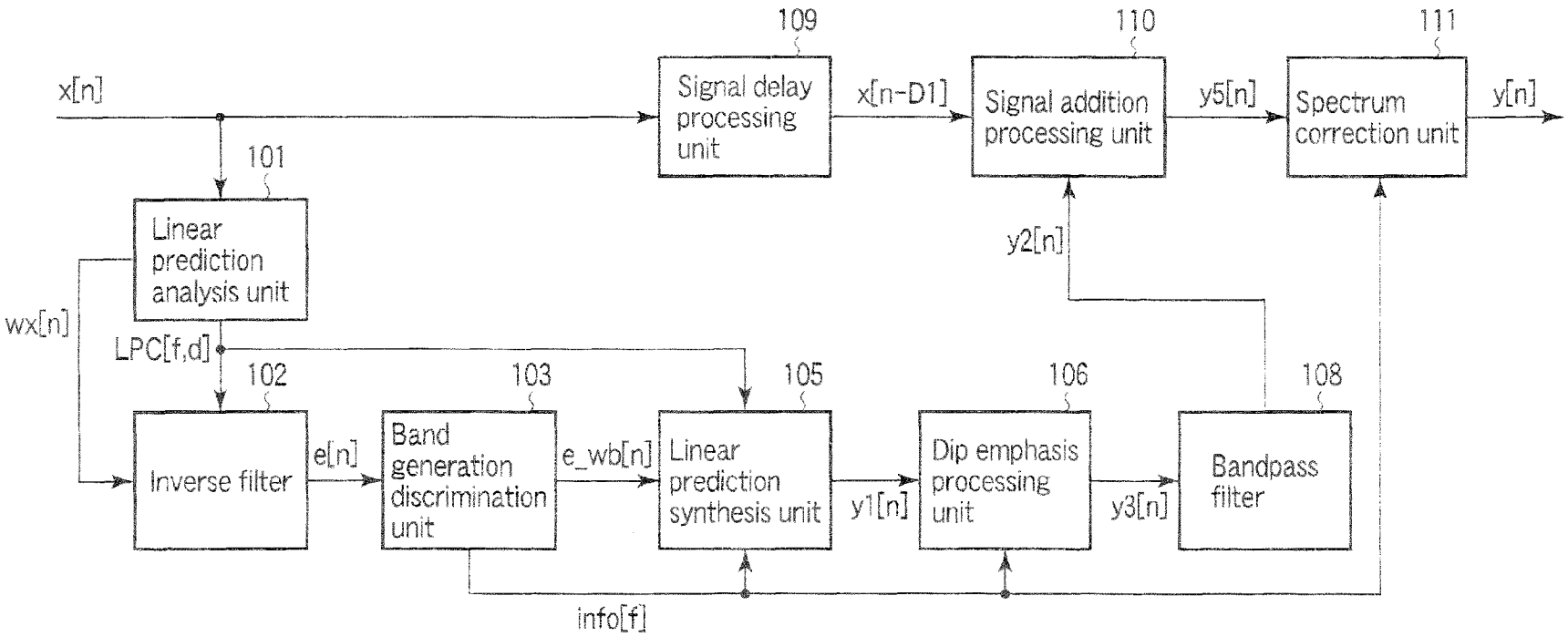
FIG. 14 is a block diagram showing the arrangement of the third embodiment of a signal bandwidth extension apparatus according to the present invention.

The third embodiment of the bandwidth extension processing unit 3 according to the present invention will be described below. FIG. 14 shows the arrangement of the bandwidth extension processing unit 3 of this embodiment. In the following description, the same reference numerals denote the same components as in the aforementioned embodiments, and a repetitive description thereof will be avoided as needed for the sake of simplicity.

In the bandwidth extension processing unit 3 according to the third embodiment, a dip emphasis processing unit 106 is arranged between the linear prediction synthesis unit 105 and bandpass filter 108 in the bandwidth extension processing unit 3 of the first embodiment, and a spectrum correction unit 111 is added after the signal addition processing unit 110.

When control information info[f]=1, the dip emphasis processing unit 106 applies dip emphasis processing of power spectra to first wideband signal y1[n] of a data length 2N, which is synthesized by the linear prediction synthesis unit 105, and outputs signal y3[n] obtained by this processing to the bandpass filter 108. On the other hand, when the control information info[f]=0, the dip emphasis processing unit 106 skips dip emphasis processing, and outputs the first wideband signal y1[n] as the signal y3[n] intact to the bandpass filter 108.

The operation of the dip emphasis processing unit 106 will be described in more detail below. The dip emphasis processing unit 106 transforms the wideband signal y1[n] of the data length 2N, which has undergone wideband processing, into those of a frequency domain by processing such as FFT using 2N points, thus obtaining frequency spectra Y1[f,ω], However, the size of the FFT is not limited to this, and signal to which the FFT is applied is zero-padded to convert the data length into the power of 2, so as to set the size of the FFT to be the power of 2.

The dip emphasis processing unit 106 also calculates power spectra $|Y1[f,\omega]|^2$ from the frequency spectra Y1[f,ω].

Then, the dip emphasis processing unit 106 calculates an average value Y_powthr1[f] of the power spectra $|Y1[f,\omega]|^2$ in association with a frequency bin ω to be extended, which meets fs_wb_low≦fs·ω/2N [Hz]≦fs_nb_low [Hz]. Also, the dip emphasis processing unit 106 calculates an average value Y_powavr2[f] of the power spectra in a frequency band which meets $|Y1[f,\omega]|^2$<Y_powthr1[f].

The dip emphasis processing unit 106 extracts, as dips of power spectra in the frequency domain, a frequency bin which is smaller than the power spectra of neighboring frequency bins that meet $|Y1[f,\omega-1]|^2>|Y1[f,\omega]|^2$ and $|Y1[f,\omega]|^2<|Y1[f,\omega+1]|^2$, and assumes a local minimal value, and a frequency bin which meets $|Y1[f,\omega]|^2$<Y_powavr2[f] and has a small power spectrum. After that, the dip emphasis processing unit 106 sets a dip emphasis gain G[f,ω] for these extracted frequency bins to be smaller than 1 (e.g., 0), and sets G[f,ω]=1 for frequency bins which are not extracted as dips of power spectra in the frequency domain.

Finally, the dip emphasis processing unit 106 multiplies the frequency spectra Y1[f,ω] by the dip emphasis gains G[f,ω], and transforms these products into those of a time domain by, e.g., IFFT, thus obtaining dip-emphasized signal y3[n] of the data length 2N.

When the control information info[f]=1, the spectrum correction unit 111 applies spectrum correction processing to wideband signal y5[n](corresponding to the wideband signal y[n] in the first embodiment) of the data length N output from the addition processing of the signal addition processing unit 110, so as to emphasize a band fs_wb_low [Hz] to fs_nb_low [Hz] to be extended, thereby outputting spectrum-corrected signal as signal y[n]. More specifically, the spectrum correction unit 111 transforms the wideband signal y5[n] of the data length N into that of a frequency domain by processing such as FFT using 2N points to obtain, frequency spectra Y5[f,ω]. However, the size of the FFT is not limited to this, and signal to which the FFT is applied is zero-padded to convert the data length into the power of 2, so as to set the size of the FFT to be the power of 2. Then, the spectrum correction unit 111 multiplies the frequency spectra Y5[f,ω] by spectrum correction gains G'[f,ω] which are set in advance to be G'[f,ω]≧ 1 for the band fs_wb_low [Hz] to fs_nb_low [Hz] to be extended and G'[f,ω]2N for frequency bins of other bands, and transforms these products into those of a time domain by, e.g., IFFT, thus obtaining wideband signal y[n] of the data length N that has undergone the spectrum correction processing. On the other hand, when the control information info[f]=0, the spectrum correction unit 111 skips the aforementioned spectrum correction processing, and outputs the signal y5[n] as signal y[n] intact.

With this arrangement as well, the same effects can be obtained. According to this arrangement, when it is determined that the fundamental frequency is lacked from input signal (control information info[f]=1), the wideband signal is obtained using the linear prediction residual signal e_wb[n] of the data length 2N, which are generated by the wideband processing of the wideband processing unit 10311. Then, the dip emphasis processing deepens dips of a harmonic structure to emphasize peaks and dips in association with widebanded signal before linear prediction synthesis, so as to more reduce distortions of the harmonic structure caused by the wideband processing, thereby improving the sound quality of widebanded, bandwidth-extended signal. Since the spectrum correction processing can emphasize the band fs_wb_low [Hz] to fs_nb_low [Hz] to be extended, the sound quality of widebanded, bandwidth-extended signal can be improved. On the other hand, when it is determined that the fundamental frequency is not lacked from the input signal (control information info[f]=0), since the dip emphasis processing and spectrum correction processing can be skipped, the computational load can be suppressed.

Note that the arrangement shown in FIG. 14 includes both the dip emphasis processing unit 106 and spectrum correction unit 111. Alternatively, an arrangement including either one of these units may be adopted.

(Fourth Embodiment)

Figure 15:
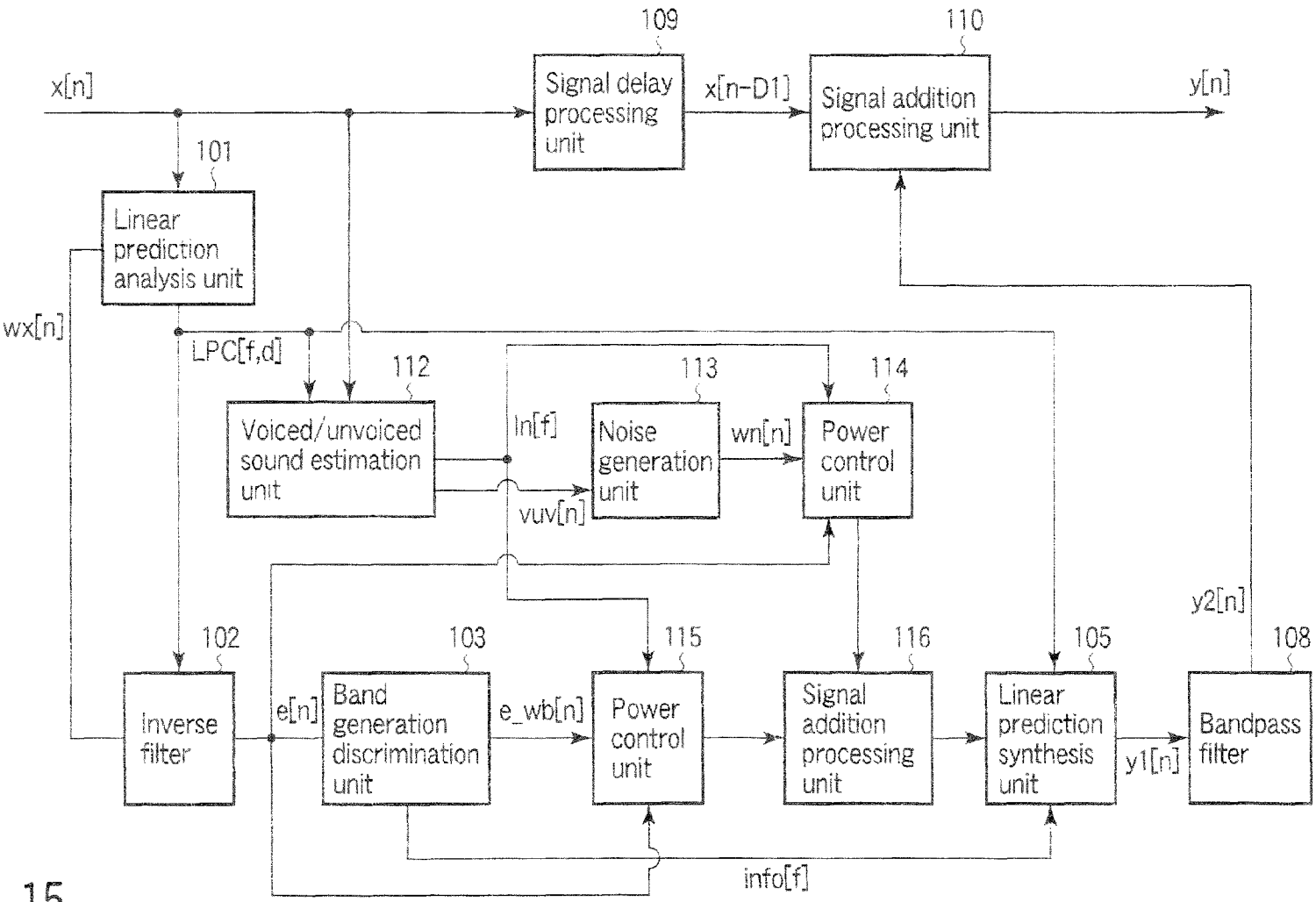
FIG. 15 is a block diagram showing the arrangement of the fourth embodiment of a signal bandwidth extension apparatus according to the present invention.

The fourth embodiment of the bandwidth extension processing unit 3 according to the present invention will be described below. FIG. 15 shows the arrangement of the bandwidth extension processing unit 3 of this embodiment. In the following description, the same reference numerals denote the same components as in the aforementioned embodiments, and a repetitive description thereof will be avoided as needed for the sake of simplicity.

In the bandwidth extension processing unit 3 according to the fourth embodiment, a power control unit 115 and signal addition processing unit 116 are arranged between the band generation discrimination unit 103 and linear prediction synthesis unit 105 in the bandwidth extension processing unit 3 of the first embodiment, and a voiced/unvoiced sound estimation unit 112, noise generation unit 113, and power control unit 114 are added.

The voiced/unvoiced sound estimation unit 112 receives input signal x[n] and linear prediction coefficients LPC[f,d] of order Dn as narrowband spectral parameters, which are obtained by linear prediction analysis of the linear prediction analysis unit 101, estimates whether the input signal x[n] corresponds to a "voiced sound" or "unvoiced sound" for each frame, and outputs estimation information vuv[f]. More specifically, the voiced/unvoiced sound estimation unit 112 calculates the number of zero-crosses for each frame from the input signal x[n], and then calculates the negative average number Zi[f] of zero-crosses by averaging the number of zero-crosses by dividing it by a frame length N and changing the sign of the average number of zero-crosses to minus. Then, the voiced/unvoiced sound estimation unit 112 calculates square sums of the input signal x[n] for each frame in a unit of dB to obtain a frame power Ci[f], as given by:

$$Ci[f] = 10\log_{10}\left(\sum_{n=0}^{N-1} x[n]\cdot x[n]\right) \quad (1)$$

Also, the voiced/unvoiced sound estimation unit 112 calculates a first-order autocorrelation coefficient In[f] for each frame by:

$$In[f] = \frac{\sum_{n=1}^{N-1} x[n-1] \cdot x[n]}{\sum_{n=0}^{N-1} x[n] \cdot x[n]} \tag{2}$$

After that, the voiced/unvoiced sound estimation unit 112 zero-pads the linear prediction coefficients LPC[f,d] of order Dn as the narrowband spectral parameters to obtain signal of 256 points, and executes FFT using 256 points to obtain frequency spectra L[f,ω]. The voiced/unvoiced sound estimation unit 112 calculates LPC spectral envelopes in a unit of dB by calculating logarithms having 10 as a base with respect to power spectra $|L[f,\omega]|^2$ as the squares of the frequency spectra L[f,ω] and multiplying the logarithms by −10, and calculates an average value Vi[f] of the LPC spectral envelopes in a band which is assumed to include the fundamental frequency, as given by:

$$Vi[f] = \frac{1}{10}\sum_{\omega=2}^{11} -10\log_{10}(|L[f,\omega]|^2) \tag{3}$$

In addition, the band expected that fundamental frequency exists, for example is assumed to be 75 [Hz]≦fs·ω/256 [Hz]≦325 [Hz]. In fact, Vi[f] is computed as an average in the range of 2 ≦ω≦11 under this assumption.

Then, the voiced/unvoiced sound estimation unit 112 monitors, for each frame, a linear sum obtained by appropriately weighting the negative average number Zi[f] of zero-crosses, frame power Ci[f], first-order autocorrelation coefficient In[f], and LPC spectral envelope average value Vi[f]. When the linear sum exceeds a predetermined threshold, the voiced/unvoiced sound estimation unit 112 estimates that the input signal corresponds to "voiced sound"; when the linear sum does not exceed the predetermined threshold, it estimates that the input signal corresponds to "unvoiced sound". Then, the voiced/unvoiced sound estimation unit 112 outputs the estimation information vuv[f].

The noise generation unit 113 generates random numbers which are uniform random when the estimation information vuv[f] as the estimation result of the voiced/unvoiced sound estimation unit 112 is "unvoiced sound", and uses them as amplitude values of signal, thus generating and outputting white noise signal wn[n] for the data length 2N.

The power control unit 114 amplifies the noise signal wn[n] generated by the noise generation unit 113 to a predetermined level based on linear prediction residual signal e[n] of the data length 2N as narrowband excitation signal output from the inverse filter 102, and the first-order autocorrelation coefficient In[f] output from the voiced/unvoiced sound estimation unit 112, and outputs the amplified signal to the signal addition processing unit 116. More specifically, the power control unit 114 calculates a gain g1[f] by calculating the square sum of the linear prediction residual signal e[n] of the data length 2N, calculating that of the noise signal wn[n] of the data length 2N, and dividing the square sum of the linear prediction residual signal e[n] by that of the noise signal wn[n]. Then, the power control unit 114 calculates a gain g2[f] which approaches 1 as the absolute value of the first-order autocorrelation function In[f] approaches 0, and approaches 0 as the absolute value of the first-order autocorrelation function In[f] approaches 1, so as to amplify a level to be enlarged if a degree of an unvoiced sound is high. The power control unit 114 multiplies the noise signal wn[n] by the gain g1[f] and g2[f].

The power control unit 115 amplifies widebanded linear prediction residual signal e_wb[n] of the data length 2N obtained by the band generation discrimination unit 103 (wideband processing unit 10311) to a predetermined level based on the linear prediction residual signal e[n] of the data length 2N as narrowband excitation signal output from the inverse filter 102, and the first-order autocorrelation coefficient In[f] output from the voiced/unvoiced sound estimation unit 112, and outputs the amplified signal to the signal addition processing unit 116. More specifically, the power control unit 115 calculates a gain g3[f] by calculating the square sum of the linear prediction residual signal e[n] of the data length 2N, calculating that of the linear prediction residual signal e_wb[n] of the data length 2N, and dividing the square sum of the linear prediction residual signal e[n] by that of the linear prediction residual signal e_wb[n]. Then, the power control unit 115 calculates a gain g4[f] which approaches 1 as the absolute value of the first-order autocorrelation coefficient In[f] approaches 1, and approaches 0 as the absolute value of the first-order autocorrelation coefficient In[f] approaches 0, so as to amplify a level to be enlarged if a degree of an voiced sound is high. The power control unit 115 multiplies the linear prediction residual signal e_wb[n] by the gain g3[f] and g4[f].

The signal addition processing unit 116 adds the noise signal wn[n] output from the power control unit 114 and the linear prediction residual signal e_wb[n] output from the power control unit 115, and outputs the sum signal as wideband excitation signal to the linear prediction synthesis unit 105.

The linear prediction synthesis unit 105 sets the linear prediction coefficients LPC[f,d], which are narrowband spectral parameters, as wideband spectral parameters intact, and synthesizes first wideband signal y1[n] of the data length N based on the wideband spectral parameters, the wideband excitation signal output from the signal addition processing unit 116, and the control information info[f].

With this arrangement as well, the same effects can be obtained. According to this arrangement, when it is determined that the fundamental frequency is lacked from input signal (control information info[f]=1), the wideband signal is obtained using the linear prediction residual signal e_wb[n] of the data length 2N, which is generated by the wideband processing of the wideband processing unit 10311, and the voiced/unvoiced sound estimation unit 112 can generate signal respectively suited to voiced and unvoiced sounds, thereby improving the sound quality of a widebanded, bandwidth-extended signal which is faithful to an original sound. On the other hand, when it is determined that the fundamental frequency is not lacked from the input signal (control information info[f]=0), since the voiced/unvoiced sound estimation unit 112, noise generation unit 113, power control units 114 and 115, and signal addition processing unit 116 need not be operated, the computational load can be suppressed.

(Fifth Embodiment)

The fifth embodiment of the bandwidth extension processing unit 3 according to the present invention will be described below. The fifth embodiment adopts a different determination method of determining whether or not a peak component of input signal is lacked from a band to be extended, i.e., whether or not input signal in which a signal component of the fundamental frequency is lacked due to the band limitation are input, compared to the first embodiment. The first embodiment determines whether or not input signal in which a signal component of the fundamental frequency is lacked due to the band limitation are input by comparing the power spectra of linear prediction residual signal before and after band extension. However, the fifth embodiment determines whether or not input signal in which a signal component of the fundamental frequency is lacked due to the band limitation are input using the power spectra of linear prediction residual signal before bandwidth extension.

Figure 16:
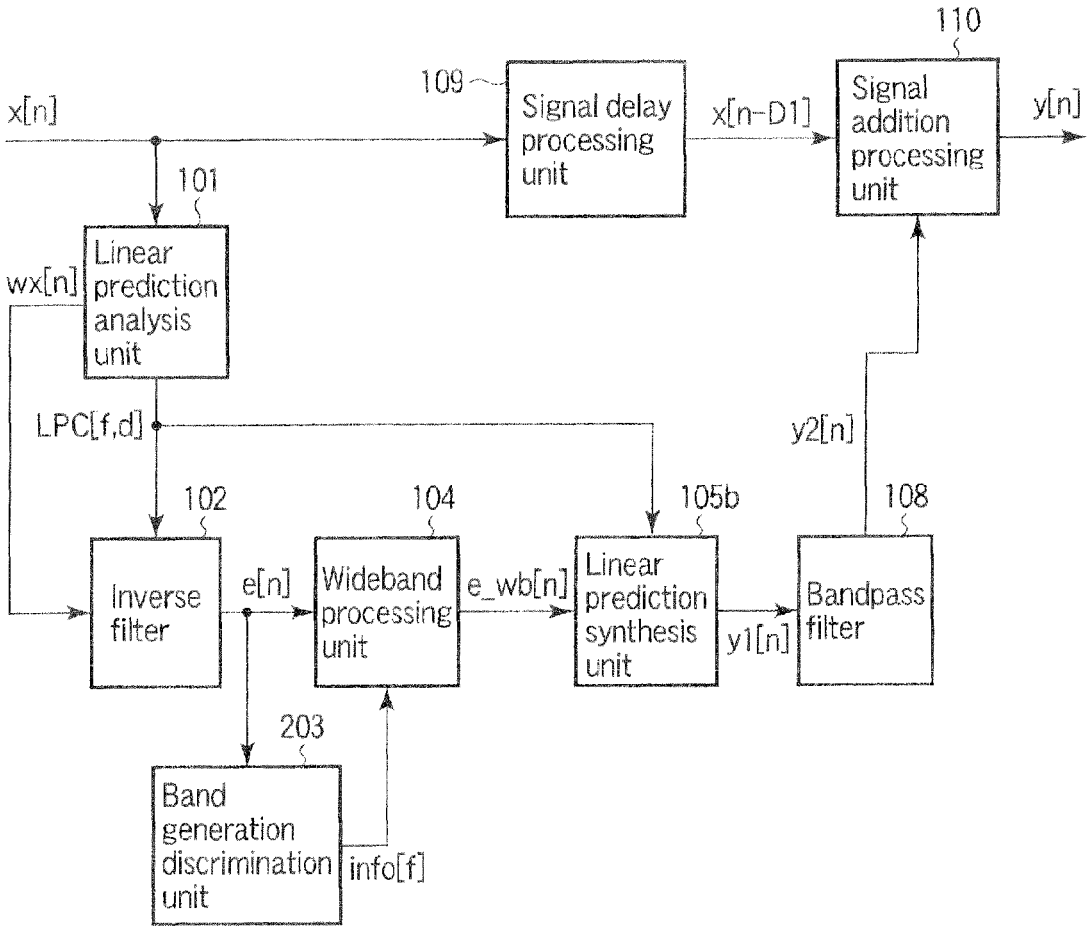
FIG. 16 is a block diagram showing the arrangement of the fifth embodiment of a signal bandwidth extension apparatus according to the present invention.

FIG. 16 shows the arrangement of the fifth embodiment of the bandwidth extension processing unit 3 according to the present invention. In the following description, the same reference numerals denote the same components as in the aforementioned embodiments, and a repetitive description thereof will be avoided as needed for the sake of simplicity. As shown in FIG. 16, the bandwidth extension processing unit 3 of the fifth embodiment includes a linear prediction analysis unit 101, inverse filter 102, band generation discrimination unit 203, wideband processing unit 104, linear prediction synthesis unit 105, bandpass filter 108, signal delay processing unit 109, and signal addition processing unit 110*b*.

The linear prediction analysis unit 101 receives input signal x[n], which is band-limited to a narrowband. The linear prediction analysis unit 101 applies linear prediction analysis to these input signal to obtain linear prediction coefficients LPC[f,d] (d=1, . . . , Dn) of order Dn as narrowband spectral parameters.

The inverse filter 102 forms an inverse filter using the linear prediction coefficients LPC[f,d] as the narrowband spectral parameters obtained by the linear prediction analysis unit 101, and inputs input signal wx[n] of a data length 2N which has undergone windowing by the linear prediction analysis unit 101 to that inverse filter, thereby obtaining linear prediction residual signal e[n] of the data length 2N as narrowband excitation signal. This signal e[n] is narrowband signal.

Figure 17:
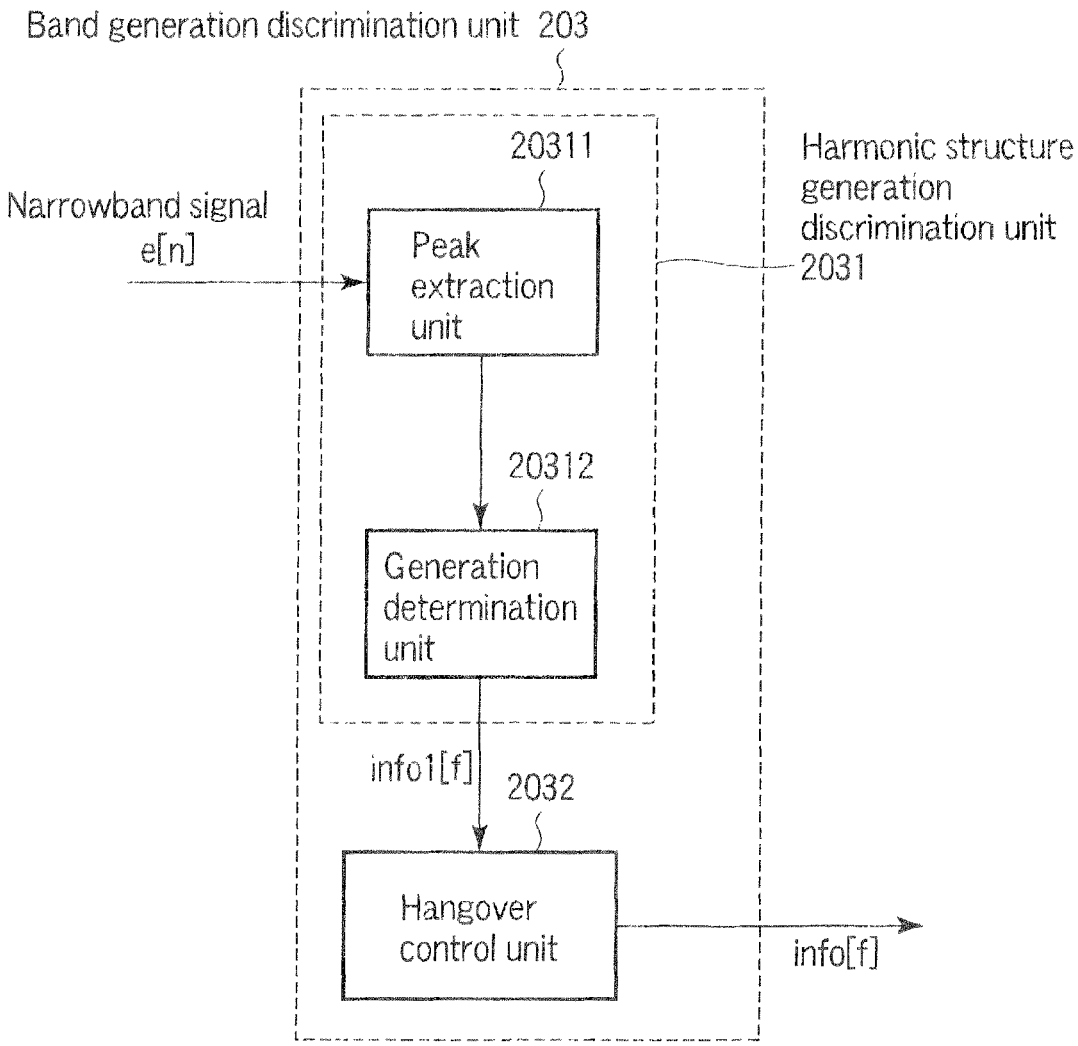
FIG. 17 is a block diagram showing an example of the arrangement of a band generation discrimination unit of the signal bandwidth extension apparatus shown in FIG. 16.
Figure 18:
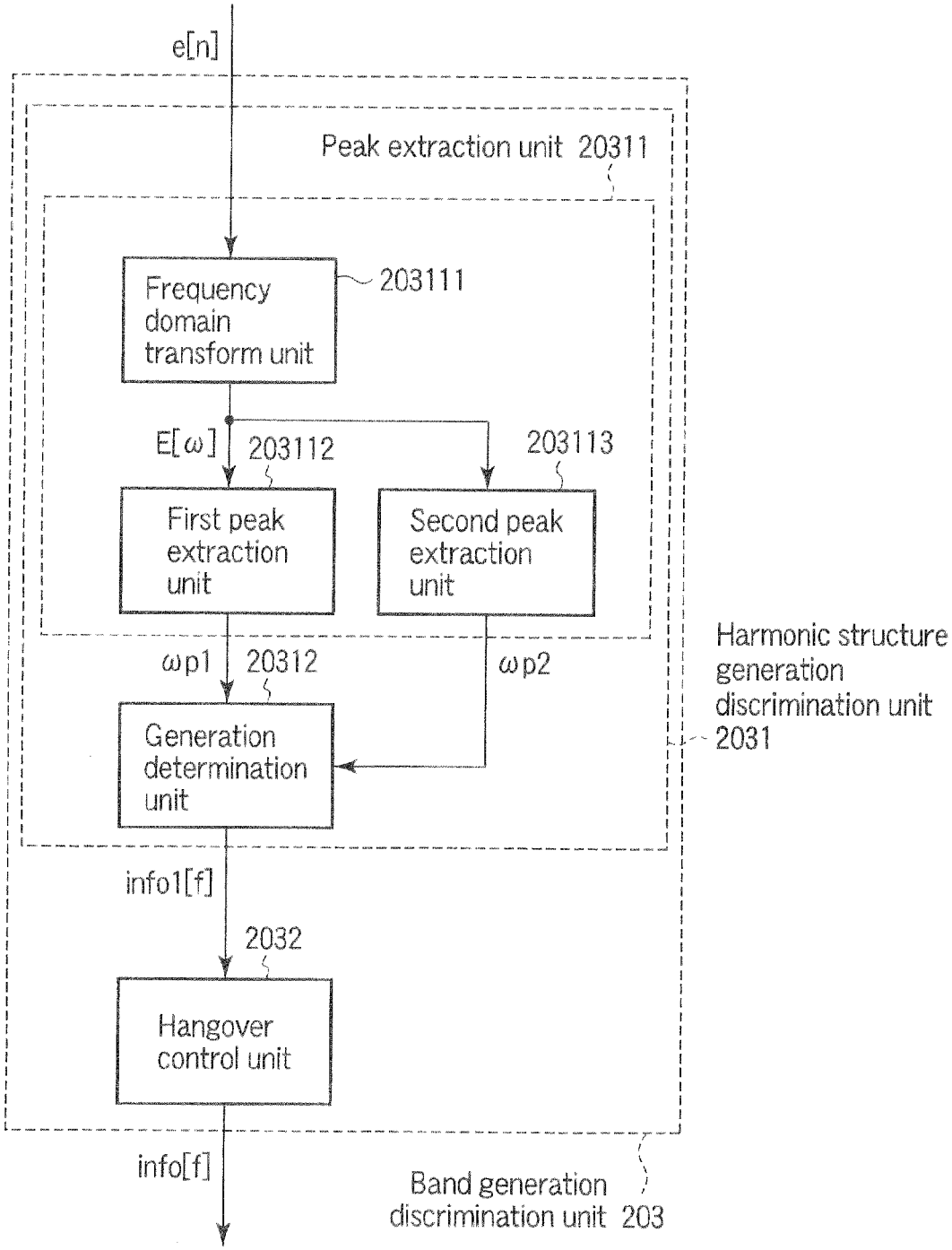
FIG. 18 is a block diagram showing another example of the arrangement of a band generation discrimination unit of the signal bandwidth extension apparatus shown in FIG. 16.

The band generation discrimination unit 203 checks whether or not a peak component of input signal is lacked from the band to be extended. That is, the band generation discrimination unit 203 determines based on the linear prediction residual signal e[n] as the narrowband excitation signal if a harmonic structure is to be generated, and outputs this determination result as control information info[f]. As shown in FIG. 17, the band generation discrimination unit 203 includes a harmonic structure generation determination unit 2031 and hangover control unit 2032. The harmonic structure generation determination unit 2031 includes a peak extraction unit 20311 and generation determination unit 20312. As shown in FIG. 18, the peak extraction unit 20311 includes a frequency domain transform unit 203111, first peak extraction unit 203112, and second peak extraction unit 203113.

The peak extraction unit 20311 calculates power spectra of the narrowband signal e[n], and detects at least two frequencies (peaks) having powers equal to or larger than a predetermined level in turn from a low frequency toward a high frequency from the power spectra.

The frequency domain transform unit 203111 receives the linear prediction residual signal e[n] of the data length 2N, transforms this signal into those of a frequency domain by applying processing such as FFT (Fast Fourier Transform) using 2N points to this signal, calculates frequency spectra E[ω,f] of the linear prediction residual signal e[n], and then calculates power spectra $|E[\omega,f]|^2$. In the following description, assume that ω represents index of the frequency bin, and $1 \leqq \omega \leqq 2N$.

The first peak extraction unit 203112 detects, as a first frequency (peak), a frequency ωp1[f] [Hz] at which the power spectrum $|E[\omega,f]|^2$ assumes a local maximal value and which has a power equal to or larger than a predetermined level, from a frequency band of a pre-set search range, based on the power spectra $|E[\omega,f]|^2$.

Likewise, the second peak extraction unit 203113 detects, as a second frequency (peak), a frequency ωp2[f] [Hz] at which the power spectrum $|E[\omega,f]|^2$ assumes a local maximal value and which has a power equal to or larger than a predetermined level, from a frequency band of a pre-set search range, based on the power spectra $|E[\omega,f]|^2$. Note that the second peak extraction unit 203113 conducts a search in a frequency band which is contiguous with the search range of the first peak extraction unit 203112 and is higher than this search range, thereby detecting a peak different from the first peak extraction unit 203112.

The generation determination unit 20312 checks based on a frequency difference between the first frequency ωp1[f] [Hz] and second frequency ωp2[f] [Hz] as the two peaks detected by the peak extraction unit 20311 whether or not the fundamental frequency of the input signal x[n] is lacked from the band to be extended, thereby determining whether or not wideband signal is to be generated using linear prediction residual signal e_wb[n] generated by the wideband processing unit 104. Then, the generation determination unit 20312 outputs this determination result as determination information info1[f]. More specifically, the generation determination unit 20312 calculates a difference ωp2[f]−ωp1[f] [Hz] between the first frequency ωp1[f] [Hz] detected by the first peak extraction unit 203112 and the second frequency ωp2[f] [Hz] detected by the second peak extraction unit 203113, and checks whether or not a frequency ωp1[f]−(ωp2[f]−ωp1[f]) [Hz] as a difference obtained by subtracting the difference from the first frequency ωp1[f] [Hz] falls within a band fs_wb_low [Hz] to fs_nb_low [Hz] as a low band to be extended to see whether or not the fundamental frequency is lacked from the input signal x[n].

Figure 19A:
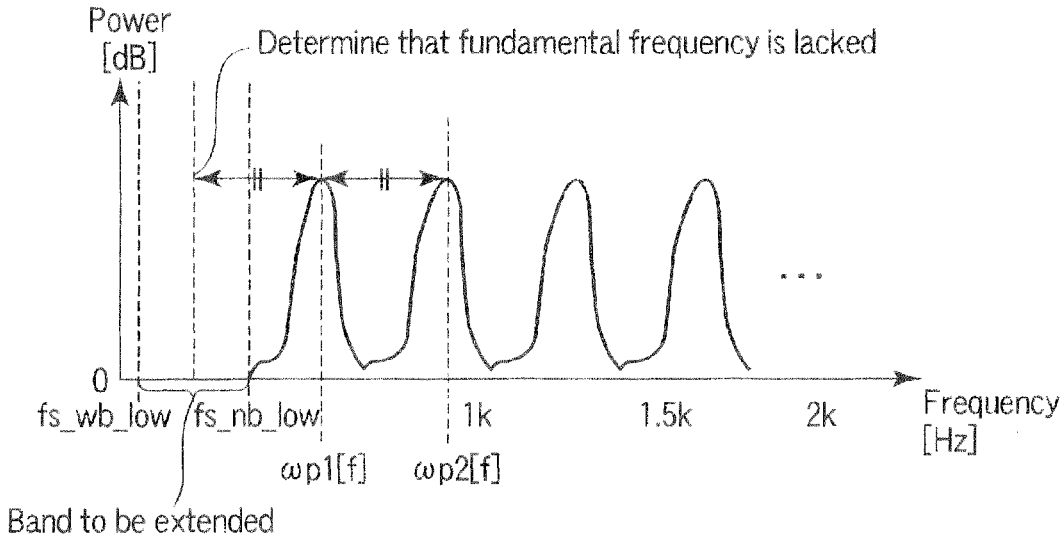
FIGS. 19A and 19B are input signal waveform charts for explaining the operation of the signal bandwidth extension apparatus shown in FIG. 16.
Figure 19B:
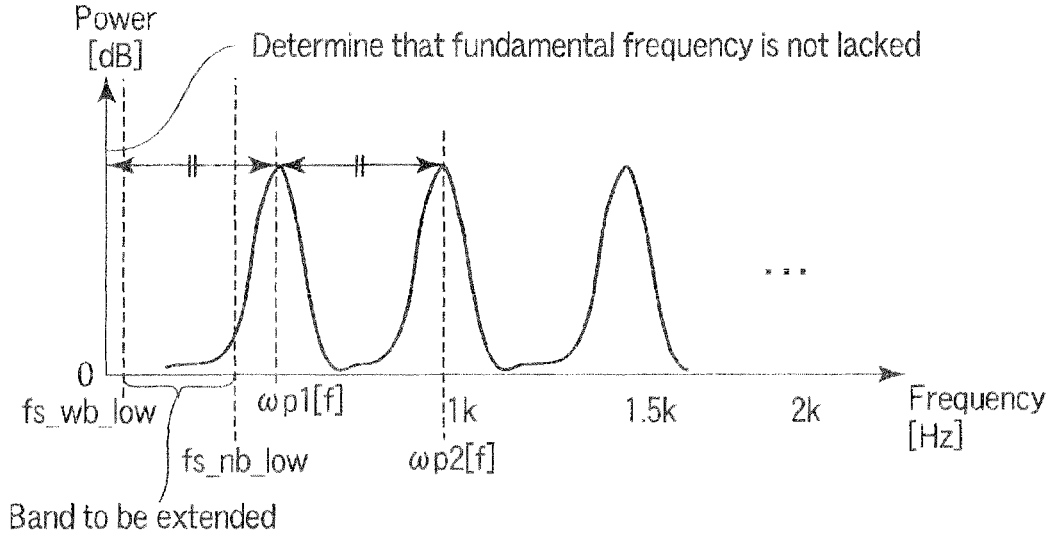

For example, when the first frequency ωp1[f] [Hz] and the second frequency ωp2[f] [Hz] are calculated, as shown in FIG. 19A, since the frequency ωp1[f]−(ωp2[f]−ωp1[f]) [Hz] falls within the band fs_wb_low [Hz] to fs_nb_low [Hz] as the low band to be extended, the generation determination unit 20312 determines that the fundamental frequency is lacked from the input signal x[n], and outputs determination information info1[f]=1. On the other hand, when the first frequency ωp1[f] [Hz] and the second frequency ωp2[f] [Hz] are calculated, as shown in FIG. 19B, since the frequency ωp1[f]−(ωp2[f]−ωp1[f]) [Hz] falls outside the band fs_wb_low [Hz] to fs_nb_low [Hz] as the low band to be extended, the generation determination unit 20312 determines that the fundamental frequency is not lacked from the input signal x[n], and outputs determination information info1[f]=0.

The hangover control unit 2032 levels pieces of determination information info1[f] from the generation determination unit 20312, and outputs leveled information as control information info[f]. Since execution/non-execution of the band generation processing based on the determination information info1[f] is consequently determined for only each frame of a voiced sound, a determination result changes based on an unvoiced sound in one utterance, thus producing abnormal noise. Therefore, this leveling is done so as to prevent execution/non-execution of the band generation processing from being switched for respective frames in one utterance, and control information info[f]="1" or "0" is output based on pieces of control information info[f] obtained for a plurality of previous successive frames.

When the control information info[f]=1, the wideband processing unit 104 applies nonlinear processing to the linear prediction residual signal e[n] of the data length 2N as the band-limited narrowband excitation signal which is obtained by the inverse filter 102 so as to convert them into wideband signal having a structure (harmonic structure) which has peaks in the frequency domain for respective overtones of the fundamental frequency in a voiced sound, thus obtaining widebanded linear prediction residual signal e_wb[n] of the data length 2N as wideband excitation signal. On the other hand, when the control information info[f]=0, the wideband processing unit 104 skips the nonlinear processing, and outputs the linear prediction residual signal e[n] as linear prediction residual signal e_wb[n] as wideband excitation signal.

The linear prediction synthesis unit 105*b* sets the linear prediction coefficients LPC[f,d], which are narrowband spectral parameters, as wideband spectral parameters, and synthesizes first wideband signal y1[n] of the data length N based on the wideband spectral parameters, the linear prediction residual signal e_wb[n] of the data length N as the wideband excitation signal, and the control information info[f], as described in the first embodiment.

With this arrangement as well, the same effects can be obtained. According to this arrangement, since the linear prediction residual signal e[n] is analyzed without generating and analyzing the linear prediction residual signal e_wb[n], which has undergone the wideband processing of the wideband processing unit 104, an effect of generating a bandwidth-extended signal which is more faithful to an original sound and has good sound quality with a lighter computational load can be obtained.

As in the first embodiment, the linear prediction synthesis unit 105 shown in FIG. 9, the linear prediction synthesis unit 105*a* shown in FIG. 10, or the linear prediction synthesis unit 105*c* shown in FIG. 11 may be used in place of the linear prediction synthesis unit 105*b*. As in the second embodiment, the signal addition processing unit 110*b* shown in FIG. 13 may be used in place of the signal addition processing unit 110. With these arrangements, the same effects as in the fifth embodiment can be obtained. Also, according to these arrangements, an effect of generating a bandwidth-extended signal which is more faithful to an original sound and has good sound quality with a lighter computational load than the fifth embodiment can be obtained.

(Sixth Embodiment)

Figure 20:
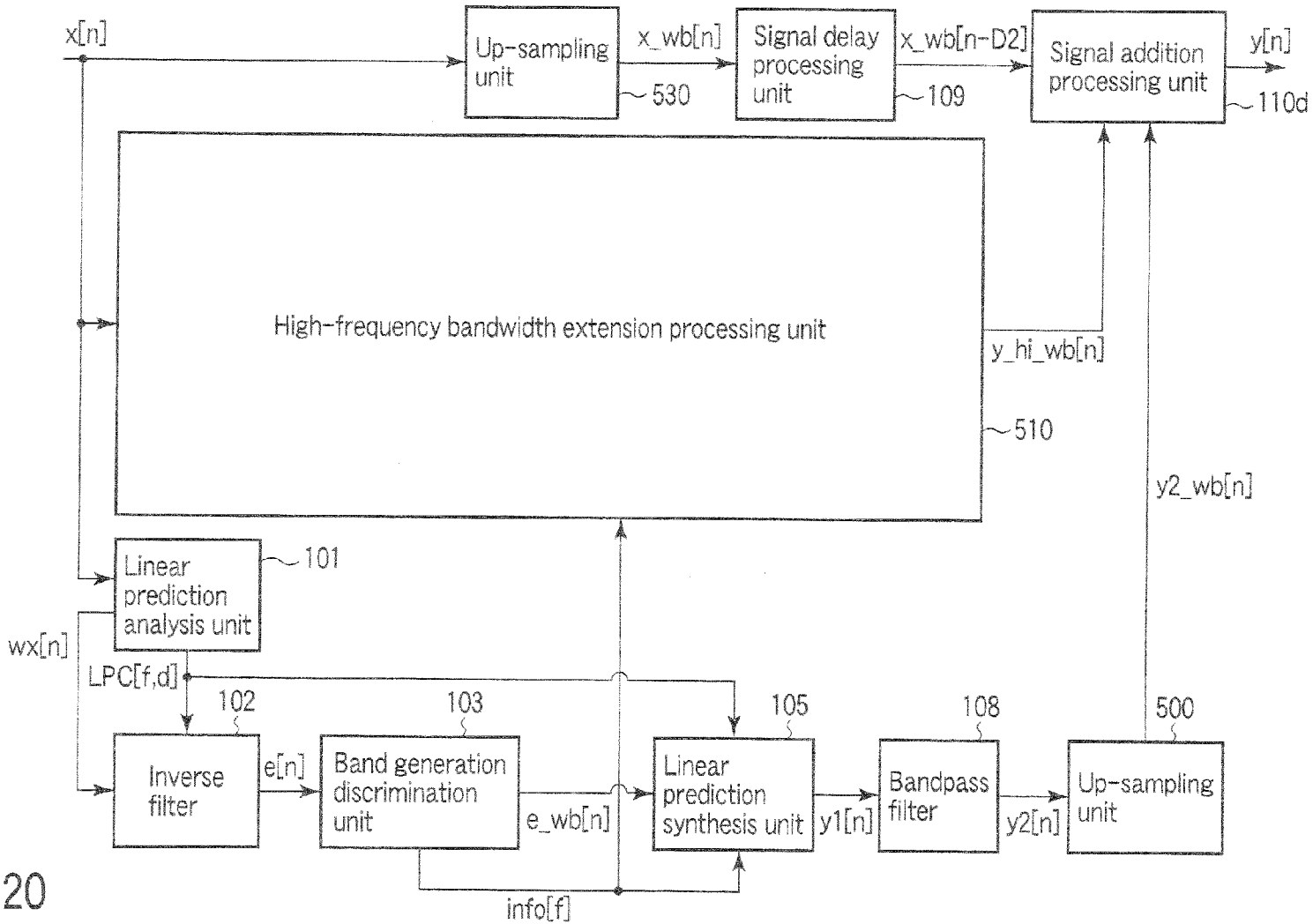
FIG. 20 is a block diagram showing the arrangement of the sixth embodiment of a signal bandwidth extension apparatus according to the present invention.

The sixth embodiment of the bandwidth extension processing unit 3 according to the present invention will be described below. FIG. 20 shows the arrangement of the bandwidth extension processing unit 3 of this embodiment. The bandwidth extension processing unit 3 of each of the aforementioned embodiments executes low-frequency bandwidth extension, but the bandwidth extension processing unit 3 of this embodiment has a function of also extending a high-frequency bandwidth. In the following description, the same reference numerals denote the same components as in the aforementioned embodiments, and a repetitive description thereof will be avoided as needed for the sake of simplicity.

In the sixth embodiment, assume that input signal x[n] (n=0, 1, . . . , N−1) to the bandwidth extension processing unit 3 is band-limited from fs_nb_low [Hz] to fs_nb_high [Hz], and are extended to a band from fs_wb_low [Hz] to fs_wb_high [Hz] by changing a sampling frequency fs [Hz] to a higher sampling frequency fs' [Hz] by the bandwidth extension processing of the bandwidth extension processing unit 3. Note that fs_wb_low≦fs_nb_low<fs_nb_high<fs/2≦fs_wb_high<fs'/2 is held.

In the following description, since low-band extension and high-band extension will be exemplified, fs_wb_low<fs_nb_low and fs_nb_high<fs_wb_high, and assume that, for example, fs=8000 [Hz], fs'=16000 [Hz], fs_nb_low=340 [Hz], fs_nb_high=3950 [Hz], fs_wb_low=50 [Hz], and fs_wb_high=7950 [Hz]. The frequency bands of band limitations and the sampling frequencies are not limited to such specific values.

As shown in FIG. 20, the bandwidth extension processing unit 3 of the sixth embodiment includes a linear prediction analysis unit 101, inverse filter 102, band generation discrimination unit 103, linear prediction synthesis unit 105, bandpass filter 108, up-sampling unit 500, high-frequency bandwidth extension processing unit 510, up-sampling unit 530, signal delay processing unit 109, and signal addition processing unit 110*d*. These units can also be implemented by one processor and software recorded on a storage medium (not shown).

The linear prediction analysis unit 101 receives input signal x[n], which is band-limited to a narrowband. The linear prediction analysis unit 101 applies linear prediction analysis to this input signal to obtain linear prediction coefficients LPC[f,d] (d=1, . . . , Dn) of order Dn as narrowband spectral parameters.

The inverse filter 102 forms an inverse filter using the linear prediction coefficients LPC[f,d] as the narrowband spectral parameters obtained by the linear prediction analysis unit 101, and inputs input signal wx[n] of a data length 2N which has undergone windowing by the linear prediction analysis unit 101 to that inverse filter, thereby obtaining linear prediction residual signal e[n] of the data length 2N as narrowband excitation signal.

The band generation discrimination unit 103 receives the linear prediction residual signal e[n] as band-limited narrowband signal, and generates linear prediction residual signal e_wb[n] as wideband excitation signal obtained by bandwidth-extending the received signal. Also, the band generation discrimination unit 103 generates control information info[f] indicating whether or not to execute band generation for each frame. This signal and information are output to the linear prediction synthesis unit 105. The practical arrangement example of the band generation discrimination unit 103 is the same as that described using FIGS. 3 to 6 in the first embodiment.

The linear prediction synthesis unit 105 sets the linear prediction coefficients LPC[f,d], which are narrowband spectral parameters, as wideband spectral parameters intact, and generates first wideband signal y1[n] of a data length N based on the wideband spectral parameters, the linear prediction residual signal e_wb[n] of the data length 2N as the wideband excitation signal, and the control information Info[f]. The practical arrangement example of the linear prediction synthesis unit 105 is the same as that described using FIG. 9 in the first embodiment.

The bandpass filter 108 applies filter processing that allows to pass only signal of a frequency band to be extended to the wideband signal y1[n] of the data length N, and outputs the passed signal, i.e., those of the frequency band to be extended as second wideband signal y2[n] of the data length N. That is, the filter processing allows signal to pass through the frequency band from fs_wb_low [Hz] to fs_nb_low [Hz], and signal of this frequency band is obtained as the second wideband signal y2[n].

The up-sampling unit 500 up-samples the second wideband signal y2[n] from the sampling frequency fs [Hz] to fs' [Hz] to remove aliasing, and outputs the up-sampled signal as signal y2_wb[n].

Figure 21:
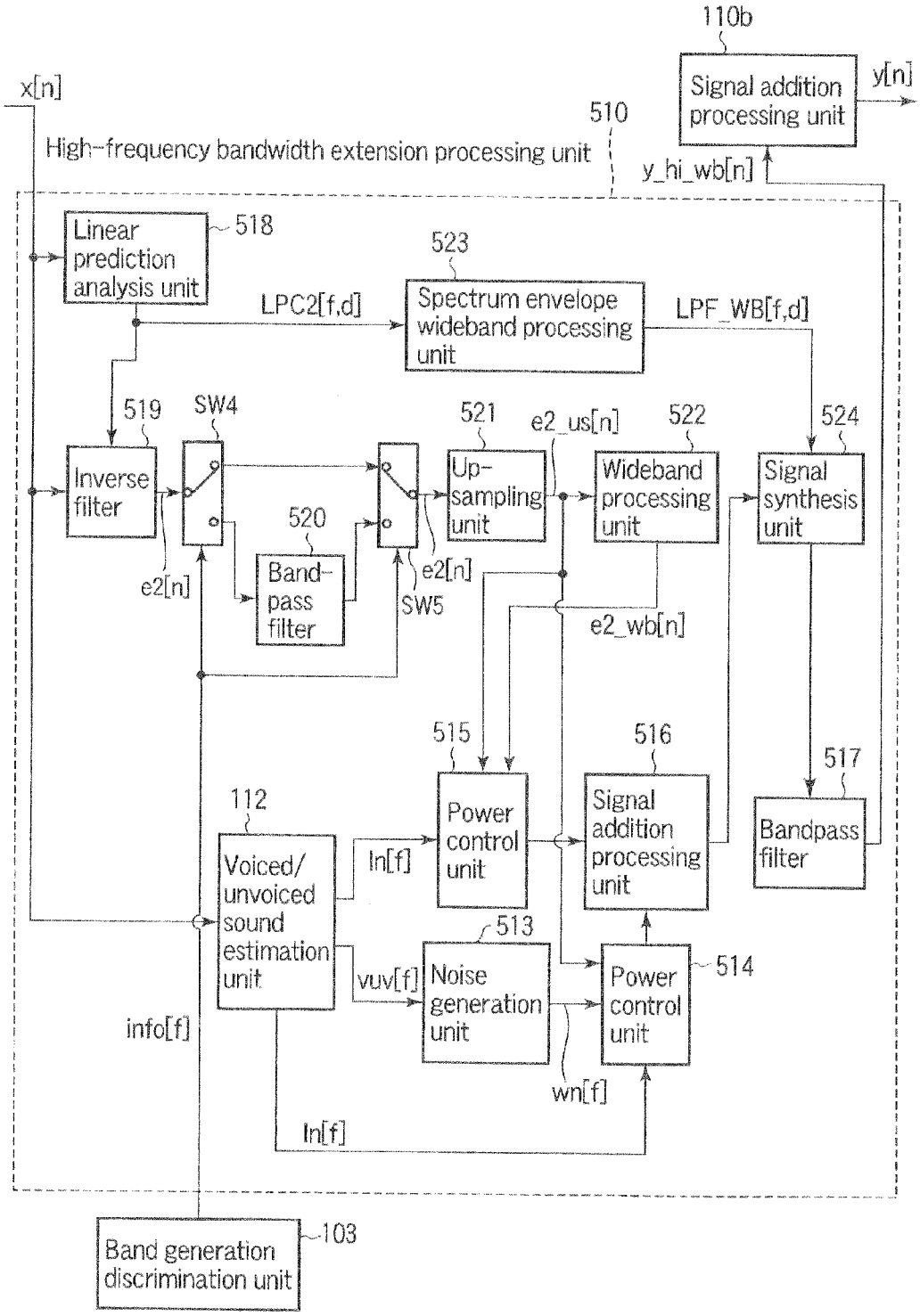
FIG. 21 is a block diagram showing an example of the arrangement of a high-frequency bandwidth extension processing unit of the signal bandwidth extension apparatus shown in FIG. 20.

The high-frequency bandwidth extension processing unit 510 applies high-frequency bandwidth extension processing to the input signal x[n] to generate wideband signal y_hi_wb [n] by extending a frequency band higher than that of the input signal x[n]. The high-frequency bandwidth extension processing unit 510 has an arrangement, as shown in, e.g., FIG. 21.

A linear prediction analysis unit 518 executes the same processing as the linear prediction analysis unit 101. That is, the linear prediction analysis unit 518 receives the input signal x[n], which is band-limited to a narrowband. The linear prediction analysis unit 518 applies linear prediction analysis to this input signal to obtain linear prediction coefficients LPC2[f,d] (d=1, . . . , Dnb) of order Dnb as second narrowband spectral parameters. Note that, for example, Dnb=10. Of course, by setting Dnb=Dn and LPC2[f,d]=LPC[f,d], i.e., by setting the narrowband spectral parameters and the second narrowband spectral parameters as the same parameters, the processing of the linear prediction analysis unit 518 may be commonized to that of the linear prediction analysis unit 101.

An inverse filter 519 executes the same processing as the inverse filter 102. That is, the inverse filter 519 forms an inverse filter using the linear prediction coefficients LPC2[f, d] as the second narrowband spectral parameters obtained by the linear prediction analysis unit 518, and inputs input signal wx[n] of the data length 2N which has undergone windowing by the linear prediction analysis unit 518 to that inverse filter, thereby obtaining linear prediction residual signal e2[n] of the data length 2N as second narrowband excitation signal. Of course, by setting Dnb=Dn and LPC2[f,d]=LPC[f,d], i.e., by commonizing the processing of the inverse filter 519 to that of the inverse filter 102, the narrowband excitation signal and the second narrowband excitation signal may be set to be the same signal.

Switches SW4 and SW5 are changeover-controlled according to the control information info[f], which is obtained by the band generation discrimination unit 103 and indicates whether or not to execute band generation. When band generation is to be executed, i.e., when the control information info[f]=1, the switches SW4 and SW5 output the linear prediction residual signal e2[n] of the data length 2N obtained by the inverse filter 519 to a bandpass filter 520. On the other hand, when band generation is not to be executed, i.e., when the control information info[f]=0, the switches SW4 and SW5 output the linear prediction residual signal e2[n] of the data length 2N obtained by the inverse filter 519 to an up-sampling unit 521 intact.

The bandpass filter 520 is a filter which filters the linear prediction residual signal e2[n] as the output from the inverse filter 519 to pass through a frequency band used in wideband processing, and has a characteristic of reducing at least a low band so as to eliminate the influence of the low band which deteriorates due to the band limitation. Note that the bandpass filter 520 passes signal ranging from, for example, 1000 [Hz] to 3400 [Hz]. More specifically, the bandpass filter 520 receives the linear prediction residual signal e2[n] of the data length 2N obtained by the inverse filter 519, applies bandpass filter processing to the received signal, and outputs the linear prediction residual signal that has undergone the bandpass filter processing as signal e2[n] to the up-sampling unit 521 via the switch SW5.

The up-sampling unit 521 executes the same processing as the up-sampling unit 500. That is, the up-sampling unit 521 up-samples the signal e2[n] output via the switch SW5 from the sampling frequency fs [Hz] to fs' [Hz] to remove aliasing, and outputs the up-sampled signal as signal e2_us[n] of a data length 4N.

A wideband processing unit 522 executes the same processing as the wideband processing unit 10311. That is, the wideband processing unit 522 applies nonlinear processing to the signal e2_us[n] of the data length 4N output from the up-sampling unit 521 so as to convert it into wideband signal having a structure (harmonic structure) which has peaks in the frequency domain for respective overtones of the fundamental frequency in a voiced sound. As a result, widebanded linear prediction residual signal e2_wb[n] of the data length 4N is obtained.

A noise generation unit 513 generates random numbers which are uniform random when estimation information vuv [f] as an estimation result of a voiced/unvoiced sound estimation unit 112 is "unvoiced sound", and uses them as amplitude values of signal, thus generating and outputting white noise signal wn[n] for the data length 4N.

A power control unit 514 amplifies the noise signal wn[n] generated by the noise generation unit 513 to a predetermined level based on the signal e2_us[n] of the data length 4N output from the up-sampling unit 521, and a first-order autocorrelation coefficient In[f] output from the voiced/unvoiced sound estimation unit 112, and outputs the amplified signal to a signal addition processing unit 516. More specifically, the power control unit 514 calculates a gain g1[f] by calculating the square sum of the signal e2_us[n] of the data length 4N, calculating that of the noise signal wn[n] of the data length 4N, and dividing the square sum of the signal e2_us[n] by that of the noise signal wn[n]. Then, the power control unit 514 calculates a gain g2[f] which approaches 1 as the absolute value of the first-order autocorrelation function In[f] approaches 0, and approaches 0 as the absolute value of the first-order autocorrelation function In[f] approaches 1, so as to amplify a level to be higher for an unvoiced sound. The power control unit 514 multiplies the noise signal wn[n] by the gain g1[f] and g2[f].

A power control unit 515 amplifies the widebanded signal e2_wb[n] of the data length 4N obtained by the wideband processing unit 522 to a predetermined level based on the signal e2_us[n] of the data length 4N output from the up-sampling unit 521, and the first-order autocorrelation coefficient In[f] output from the voiced/unvoiced sound estimation unit 112, and outputs the amplified signal to the signal addition processing unit 516. More specifically, the power control unit 515 calculates a gain g3[f] by calculating the square sum of the signal e2_us[n] of the data length 4N, calculating that of the signal e2_wb[n] of the data length 4N, and dividing the square sum of the signal e2_us[n] by that of the signal e2_wb [n]. Then, the power control unit 515 calculates a gain g4[f] which approaches 1 as the absolute value of the first-order autocorrelation function In[f] approaches 1, and approaches 0 as the absolute value of the first-order autocorrelation function In[f] approaches 0, so as to amplify a level to be higher for a voiced sound. The power control unit 515 multiplies the signal e2_wb[n] by the gain g3[f] and g4[f].

The signal addition processing unit 516 adds the noise signal wn[n] output from the power control unit 514 and the signal e2_wb[n] output from the power control unit 515, and outputs signal e3_wb[n] of the data length 4N as wideband excitation signal to a signal synthesis unit 524.

A spectral envelope wideband processing unit 523 models, in advance, correspondence between narrowband spectral parameters that represent a spectral envelope of narrowband signal, and wideband spectral parameters that represent a spectral envelope of wideband signal. The spectral envelope wideband processing unit 523 acquires second narrowband spectral parameters (the linear prediction coefficients LPC2 [f,d] in this case), and executes processing for calculating second wideband spectral parameters (line spectral frequencies LSF_WB[f,d] in this case) from the modeled correspondence between the narrowband spectral parameters and the wideband spectral parameters. As a method of converting spectral parameters that represent a narrowband spectral envelope into those that represent a wideband spectral envelope, a method using a codebook based on vector quantization (VQ) (for example, Yoshida, Abe, "Generation of Wideband Speech from Narrowband Speech by Codebook Mapping", the IEICE transactions (D-II), vol. J78-D-II, No. 3, pp. 39.1-399, March 1995.), a method using GMM (for example, K. Y. Park, H. S. Kim, "Narrowband to Wideband Conversion of Speech using GMM based Transformation", Proc. ICASSP2000, vol. 3, pp. 1843-1846, June 2000.), a method using a codebook based on vector quantization (VQ) and HMM (for example, G. Chen, V. Parsa, "HMM-based Frequency Bandwidth Extension for Speech Enhancement using Line Spectral Frequencies", Proc. ICASSP2004, vol. 1, pp. 709-712, 2004.), a method using HMM (for example, S. Yao, C. F. Chan, "Block-based Bandwidth Extension of Narrowband Speech Signal by using CDHMM", Proc. ICASSP2005, vol. 1, pp. 793-796, 2005.), and the like are available, and any of these methods may be used. Assume that this embodiment uses, for example, the method using GMM (Gaussian mixture model). The spectral envelope wideband processing unit 523 converts the linear prediction coefficients LPC2[f,d] as the second narrowband spectral parameters obtained by the linear prediction analysis unit 518 into wideband line spectral frequencies LSF_WB[f,d](d=1, . . . , Dwb) of order Dwb as second wideband spectral parameters corresponding to a band from fs_wb_low [Hz] to fs_wb_high [Hz], using GMM that model, in advance, correspondence between the linear prediction coefficients LPC2[f,d] and the line spectral frequencies LSF_WB[f,d]. Note that, for example, Dwb=18. Note that feature quantity data that represent a spectral envelope as the narrowband spectral parameters are not limited to the linear prediction coefficients, and PARCOR coefficients, reflection coefficients, line spectral frequencies, cepstral coefficients, mel frequency cepstral coefficients, and the like may be used. Likewise, feature quantity data that represent a spectral envelope as wideband spectral parameters are not limited to the line spectral frequencies and, for example, LPC coefficients, PARCOR coefficients, reflection coefficients, cepstral coefficients, mel frequency cepstral coefficients, and the like may be used.

Figure 22:
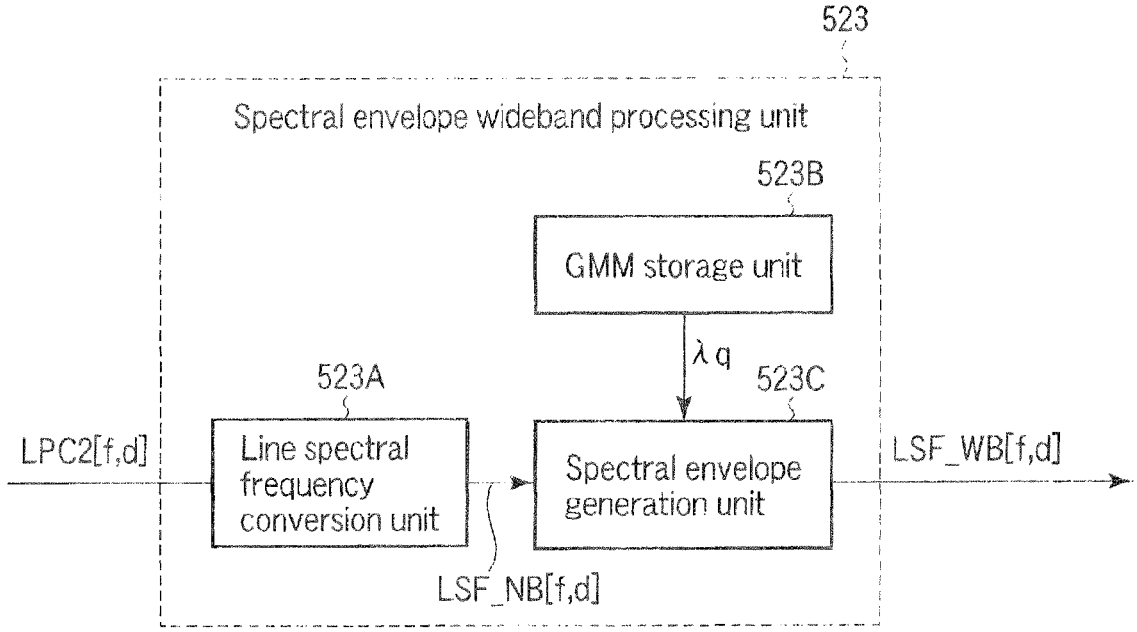
FIG. 22 is a block diagram showing an example of the arrangement of a spectral envelope wideband processing unit of the high-frequency bandwidth extension processing unit of the signal bandwidth extension apparatus shown in FIG. 21.

FIG. 22 shows a more practical arrangement example of the spectral envelope wideband processing unit 523. The spectral envelope wideband processing unit 523 includes a line spectral frequency conversion unit 323*a*, GMM storage unit 523*b*, and spectral envelope generation unit 523*c*.

The line spectral frequency conversion unit 523*a* converts the linear prediction coefficients LPC2[f,d] (d=1, . . . , Dnb) as the second narrowband spectral parameters into line spectral frequencies LSF_NB[f,d](d=1, . . . , Dnb) as line spectral frequencies (LSF) of the same order, and outputs the line spectral frequencies to the spectral envelope generation unit 523*c*.

The GMM storage unit 523*b* stores GMM $\lambda_q=\{w_q, \mu_q, \Sigma_q\}$ (q=1, . . . , Q) which are learned in advance and have the number of mixtures Q (Q=64 in this case). Note that $w_q$ is a mixture weight of the q-th normal distribution, $\mu_q$ is a mean vector of the q-th normal distribution, and $\Sigma_q$ is a covariance matrix (diagonal covariance matrix or full covariance matrix) of the q-th normal distribution. Note that the order as the number of lines or rows of the mean vector μq and covariance matrix $\Sigma_q$ is Dnb+Dwb.

The spectral envelope generation unit 523*c* reads out the GMM $\lambda_q=\{w_q, \mu_q, \Sigma_q\}$ (q=1, . . . , Q) from the GMM storage unit 523*b* to have the line spectral frequencies LSF_NB[f,d] (d=1, . . . , Dnb) as inputs, and calculates and outputs line spectral frequencies LSF_WB[f,d] (d=1, . . . , Dwb) as second wideband spectral parameters that represent a spectral envelope of wideband signal according to an MMSE (Minimum Mean Square Error), as given by:

$$\text{LSF_WB}[f] = \sum_{q=1}^{Q} h_q(\text{LSF_NB}[f]) \cdot \{\mu_q^W + \Sigma_q^{WN}(\Sigma_q^{NN})^{-1}(\text{LSF_NB}[f] - \mu_q^N)\} \tag{4}$$

$$h_q(x) = \frac{\dfrac{w_q}{(2\pi)^{\frac{D_{nb}+D_{wb}}{2}} \cdot |\Sigma_q^{NN}|^{\frac{1}{2}}} \exp\left\{-\frac{1}{2}(x-\mu_q^N)^T(\Sigma_q^{NN})^{-1}(x-\mu_q^N)\right\}}{\displaystyle\sum_{j=1}^{Q} \dfrac{w_j}{(2\pi)^{\frac{D_{nb}+D_{wb}}{2}} \cdot |\Sigma_j^{NN}|^{\frac{1}{2}}} \exp\left\{-\frac{1}{2}(x-\mu_j^N)^T(\Sigma_j^{NN})^{-1}(x-\mu_j^N)\right\}}$$

$$\Sigma_q = \begin{bmatrix} \Sigma_q^{NN} & \Sigma_q^{NW} \\ \Sigma_q^{WN} & \Sigma_q^{WW} \end{bmatrix}, \mu_q = \begin{bmatrix} \mu_q^N \\ \mu_q^W \end{bmatrix}$$

Equation (4) is described as a vector of a direction of dimension (d=1, . . . , Dnb+Dwb). The mean vector $\mu_q$ is divided into $\mu_q^N$ (d=1, . . . , Dnb) and $\mu_q^W$ (d=Dnb, . . . , Dnb+Dwb) in terms of the direction of dimension. Also, the covariance matrix $\Sigma_q$ as a (Dn+Dw)×(Dn+Dw) matrix is also divided into $\Sigma_q^{NN}$ as a Dn×Dn matrix, $\Sigma_q^{NW}$ as a Dn×Dw matrix, $\Sigma_q^{WN}$ as a Dw×Dn matrix, and $\Sigma_q^{WW}$ as a Dw×Dw matrix, as described above.

Figure 23:
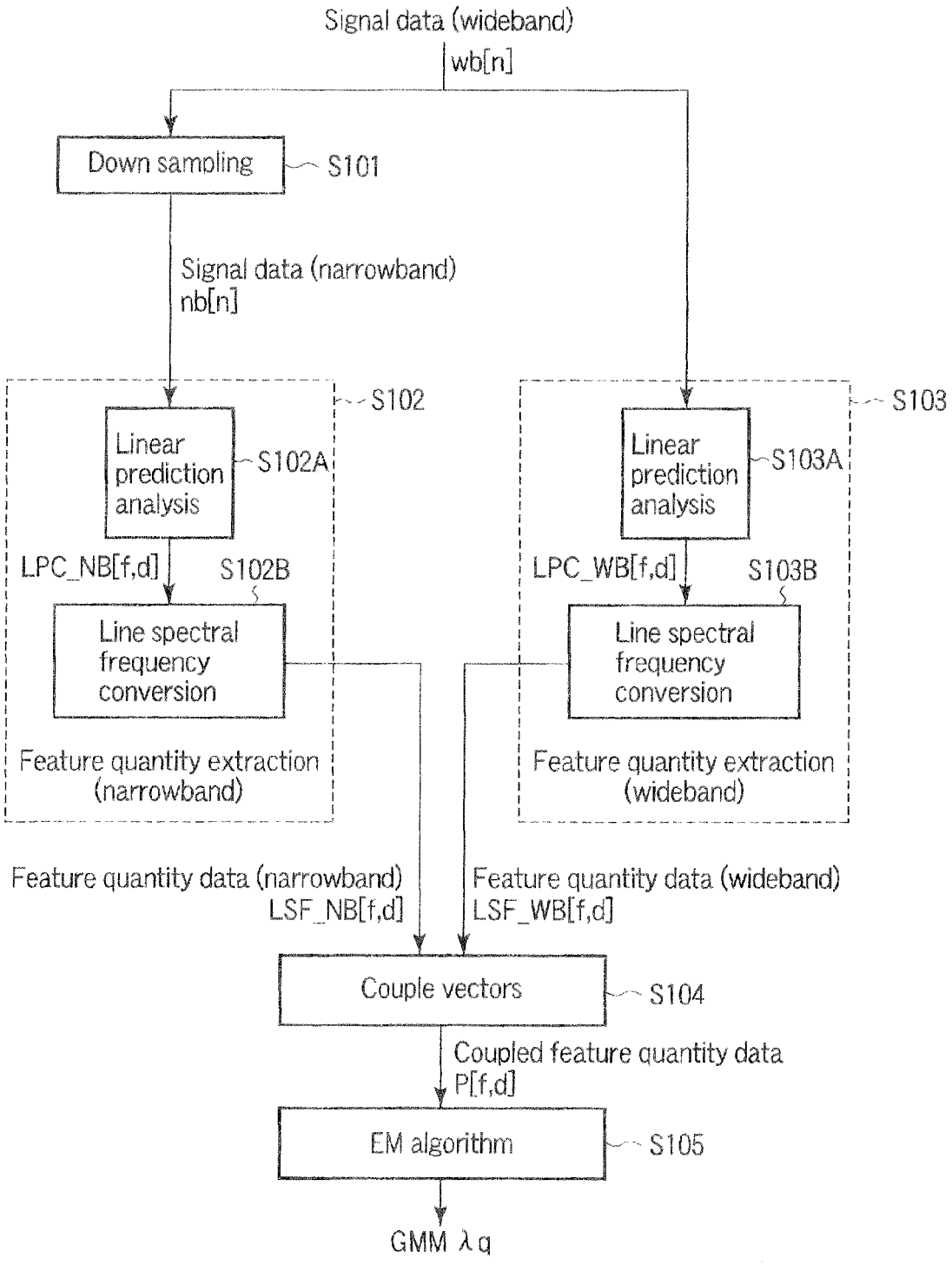
FIG. 23 is a flowchart showing a GMM learning/generation method.

FIG. 23 is a flowchart showing a prior GMM learning/generation method. This method will be described below with reference to FIG. 23.

Assume that signals used in GMM generation are ideal wideband signals (original sound) corresponding to a range from fs_wb_low [Hz] to fs_wb_high [Hz] at the sampling frequency fs' [Hz], and signal groups using speech signals as many as possible are prepared. These signal groups desirably include signals of many speakers, various volumes, and various utterance contents. In the following description, the signal groups of the ideal wideband signals used in GMM generation will be combined into one, and will be described as wideband signal data wb[n]. Also, n represents a time (sample).

The wideband signal data wb[n] are input, and are down-sampled to the sampling frequency fs [Hz] using a down-sampling filter, thus obtaining narrowband signal data nb[n] which are band-limited to a narrowband from fs_nb_low [Hz] to fs_nb_high [Hz] (step S101). In this way, a signal group which is band-limited in the same manner as the input signal x[n] is generated. Note that when an algorithm delay is generated by the down-sampling filter and band limitation processing, processing for synchronizing the narrowband signal data nb[n] with the wideband signal data wb[n] is executed, although not shown.

Feature quantity data which represent a narrowband spectral envelope of a predetermined order are extracted from the narrowband signal data nb[n] for each frame f (step S102). In step S102, the narrowband signal data nb[n] undergo linear prediction analysis for each frame to obtain linear prediction coefficients LPB_NB[f,d] (d=1, . . . , Dnb) of order Dnb (step S102A). Then, the linear prediction coefficients LPB_NB[f, d] of order Dnb are converted into line spectral frequencies LSF_NB[f,d] (d=1, . . . , Dnb) of the same order (step S102B).

On the other hand, parallel to the above processes, feature quantity data which represent a wideband spectral envelope of a predetermined order are extracted from the wideband signal data wb[n] for each frame f (step S103). In step S103, the wideband signal data wb[n] undergo linear prediction analysis for each frame to obtain linear prediction coefficients LPB_WB[f,d] (d=1, . . . , Dwb) of order Dwb (step S103A). Then, the linear prediction coefficients LPB_WB[f,d] of order Dwb are converted into line spectral frequencies LSF_WB[f,d] (d=1, . . . , Dwb) of the same order (step S103B).

Next, the two sets of feature quantity data, i.e., the line spectral frequencies LSF_NB[f,d] (d=1, . . . , Dnb) as the feature quantity data that represent the narrowband spectral envelope and the line spectral frequencies LSF_WB[f,d] (d=1, . . . , Dwb) as the feature quantity data that represent the wideband spectral envelope, which frequencies are completely temporally synchronized, are coupled for each frame in a di reaction of order (direction of dimension) to generate coupled feature quantify data P[f,d] (d=1, . . . , Dnb+Dwb) of order Dnb+Dwb (step S104).

Finally, an initial GMM with the number of mixtures Q=1 is generated from the coupled feature quantity data P[f,d]. Then, processing for slightly shifting a mean vector of each GMM to double the number of mixtures in GMM to be generated so as to increase the number of mixtures Q, and processing for executing maximum likelihood estimation of the GMM until they are converged by an EM algorithm using the coupled feature quantity data P[f,d] are alternately executed to generate GMM $\lambda_q=\{w_q, \mu_q, \Sigma_q\}$ (q=1, . . . , Q) with the number of mixtures Q (Q=64 in this case) (step S105). For details of the EM algorithm, please refer to, for example, a reference[D. A. Reynols and R. C. Rose, "Robust text-independent speaker identification using Gaussian mixture models", IEEE Trans. Speech and Audio Processing, Vol. 3, No. 1, pp. 72-83, Jan. 1995].

The signal synthesis unit 524 generates line spectral pairs LSP_WB[f,d] (d=1, . . . , Dwb) based on the line spectral frequencies LSF_WB[f,d] (d=1, . . . , Dwb) as the second wideband spectral parameters, which are obtained by the spectral envelope wideband processing unit 523. The signal synthesis unit 524 applies LSP synthesis filter processing to the linear prediction residual signal e3_wb[n] of the data length 4N as the wideband excitation signal obtained by the signal addition processing unit 516 to calculate wideband signal y1[n] of the data length 4N. The signal synthesis unit 524 then adds temporally former half data (data length 2N) of the wideband signal y1[n] of the data length 4N and temporally latter half data (data length 2N) of the wideband signal y1[n] of the data length 4N, which was output from the signal synthesis unit 524 one frame before, in consideration of their overlap components, thereby calculating wideband signal y1[n] of the data length 2N.

The up-sampling unit 530 up-samples the input signal x[n] of the data length N from the sampling frequency fs [Hz] to fs' [Hz] to remove aliasing, and outputs the up-sampled signal as signal x_wb[n] of the data length 2N.

The signal delay processing unit 109 buffers the input signal x_wb[n] of the data length 2N for a predetermined period of time (for D2 samples) to delay and output them as up-sampled input signal x_wb[n−D2], thereby adjusting the timings of this signal with that of the signal y_hi_wb[n] output from the high-frequency bandwidth extension processing unit 510 and the signal y2_wb[n] output from the up-sampling unit 500. That is, the predetermined period of time (for D2 samples) corresponds to larger one of a time period D3 obtained by subtracting a processing delay time period in the up-sampling unit 530 from that from the input to the linear prediction analysis unit 101 until the output is obtained from the up-sampling unit 500, and a time period D4 obtained by subtracting a processing delay time period in the up-sampling unit 530 from that in the high-frequency bandwidth extension processing unit 510. In this case, D3<D4, and D2=D4. The signal y2_wb[n] output from the up-sampling unit 500 is independently delayed as signal y2_wb[n−D2+D3]. This value is calculated in advance, and D2 is always used as a fixed value.

The signal addition processing unit 110*d* adds, at the sampling frequency fs' [Hz], the up-sampled input signal x_wb [n-D2] of the data length 2N, which is output from the signal delay processing unit 109, the second wideband signal y2_wb [n−D2+D3] of the data length 2N, which is output from the up-sampling unit 500, and the wideband signal y_hi_wb[n] of the data length 2N, which is output from the high-frequency bandwidth extension processing unit 510, thus obtaining wideband signal y[n] of the data length 2N as output signal. As a result, the up-sampled input signal x[n−D2] is extended by a band of the wideband signal y_hi_wb[n] and the second wideband signal y2_wb[n].

When the bandwidth extension processing unit 3 with this arrangement is applied to a signal bandwidth extension apparatus, low-frequency bandwidth extension processing is executed for an input signal, and signal before and after this bandwidth extension processing are compared to determine whether or not a fundamental frequency component in the input signal is lacked due to the band limitation. When a fundamental frequency signal in the input signal is lacked, a low-band signal component and high-band signal component generated by the bandwidth extension processing are added to extend a band. When a fundamental frequency signal in the input signal is not lacked, only a high-band signal component generated by the bandwidth extension processing is added to extend a band.

Therefore, according to the signal bandwidth extension apparatus with the above arrangement, a fundamental frequency component and high-band signal component can be added to an input signal in which the fundamental frequency is lacked by the band limitation. Only a high-band signal component is added to an input signal in which the fundamental frequency is not lacked by the band limitation. Hence, a halftone component of the fundamental frequency, which is generated by the bandwidth extension processing, can be inhibited from being added to the input signal, thus generating a bandwidth-extended signal which is more faithful to an original sound and has good sound quality.

When the bandwidth extension processing unit 3 with this arrangement is applied to the signal bandwidth extension apparatus, whether or not a fundamental frequency component in an input signal is lacked due to the band limitation is determined. When a fundamental frequency signal in the input signal is lacked, a wideband signal is generated based on a signal, at least a low band of which is attenuated by the bandpass filter, so as to eliminate the influence of the low band which deteriorates due to the band limitation. Hence, a bandwidth-extended signal which is more faithful to an original sound and has good sound quality can be generated.

Note that in the arrangement of this embodiment, the band generation discrimination unit 103 obtains the control information info[f] and widebanded linear prediction residual signal e_wb[n]. Alternatively, the band generation discrimination unit 203 shown in FIG. 17 may obtain the control information info[f], and the wideband processing unit 104 shown in FIG. 16 may obtain the widebanded linear prediction residual signal e_wb[n]. With this arrangement as well, the same effects as in the sixth embodiment can be obtained. Also, according to this arrangement, a bandwidth-extended signal which is more faithful to an original sound and has good sound quality can be generated with a lighter computational load than the sixth embodiment.

(Modification 1 of Sixth Embodiment)

Figure 24:
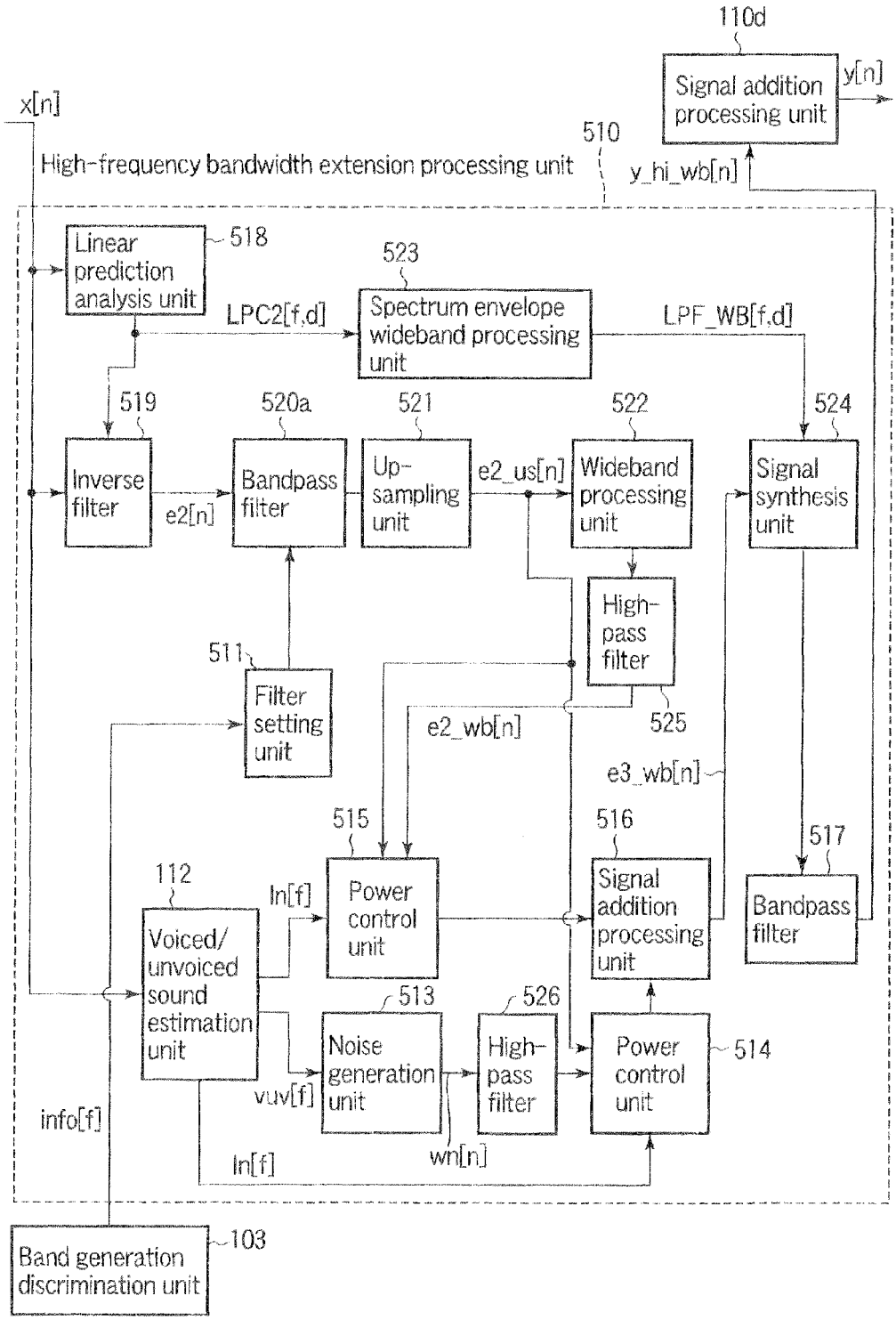
FIG. 24 is a block diagram showing a modification of the sixth embodiment of the signal bandwidth extension apparatus shown in FIG. 20.

The switches SW4 and SW5 may be lacked, and a filter setting unit 511 and bandpass filter 520*a* may be used in place of the bandpass filter 520, as shown in FIG. 24. Also, high-pass filters 525 and 526 may be added, as shown in FIG. 24.

The filter setting unit 511 sets the filter characteristics of the bandpass filter 520*a* based on the control information info[f] obtained by the band generation discrimination unit 103. More specifically, when, the control information info[f]=1, the filter setting unit 511 sets the bandpass characteristics of the filter to fall within a range from 2000 [Hz] to 3400 [Hz]. On the other hand, when the control information info[f]=0, the filter setting unit 511 sets the bandpass characteristics of the filter to fall within a range from 700 [Hz] to 3400 [Hz]. That is, when a fundamental frequency signal is lacked from the input signal, the low band side of the bandpass characteristics is set to be narrower than when the fundamental frequency signal is not lacked from the input signal. In this way, when the fundamental frequency signal is lacked from the input signal, the influence of a low band which deteriorates due to the band limitation in the linear prediction residual signal e2[n] can be eliminated more efficiently.

The bandpass filter 520*a* applies bandpass filter processing using the filter characteristics set by the filter setting unit 511 to the linear prediction residual signal e2[n] of the data length 2N as the second narrowband excitation signal obtained by the inverse filter 519, and outputs the linear prediction residual signal that has undergone the bandpass filter processing as signal e2[n] to the up-sampling unit 521.

The high-pass filter 525 executes processing using a high-pass filter that removes at least DC components to have the widebanded linear prediction residual signal e2_wb[n] of the data length 4N, which is output from the wideband processing unit 522, as inputs, and outputs the processed signal to the power control unit 515. In this way, unwanted components such as DC components included in the linear prediction residual signal e2_wb[n] generated by the wideband processing unit 522 can be lacked, and the power control unit 515 can control powers more precisely using signal free from unwanted components.

The high-pass filter 526 executes processing using a high-pass filter that removes at least DC components (for example, a filter that removes frequencies equal to or lower than 400 [Hz]) to have the noise signal wn[n] of the data length 4N, which is output from the noise generation unit 513, as inputs, and outputs the processed signal to the power control unit 514. In this way, unwanted components such as DC components included in the noise signal wn[n] generated by the noise generation unit 513 can be removed, and the power control unit 514 can control powers more precisely using signal free from unwanted components.

With this arrangement as well, the same effects as in the sixth embodiment can be obtained.

Also, according to this arrangement, since the filter setting unit 511 changes the filter settings in the bandpass filter 520*a* in accordance with the control information obtained by the band generation discrimination unit 103, when a fundamental frequency signal is lacked from the input signal, the influence of a low band which deteriorates due to the band limitation in the linear prediction residual signal e2[n] can be removed more efficiently, thus generating a bandwidth-extended signal which is more faithful to an original sound and has good sound quality. Also, the high-pass filter 525 can remove unwanted components such as DC components included in the linear prediction residual signal e2_wb[n] generated by the wideband processing unit 522, or the high-pass filter 526 can remove unwanted components such as DC components included in the noise signal wn[n] output from the noise generation unit 513, thus generating a bandwidth-extended signal which is more faithful to an original sound and has good sound quality.

(Modification 2 of Sixth Embodiment)

Figure 25:
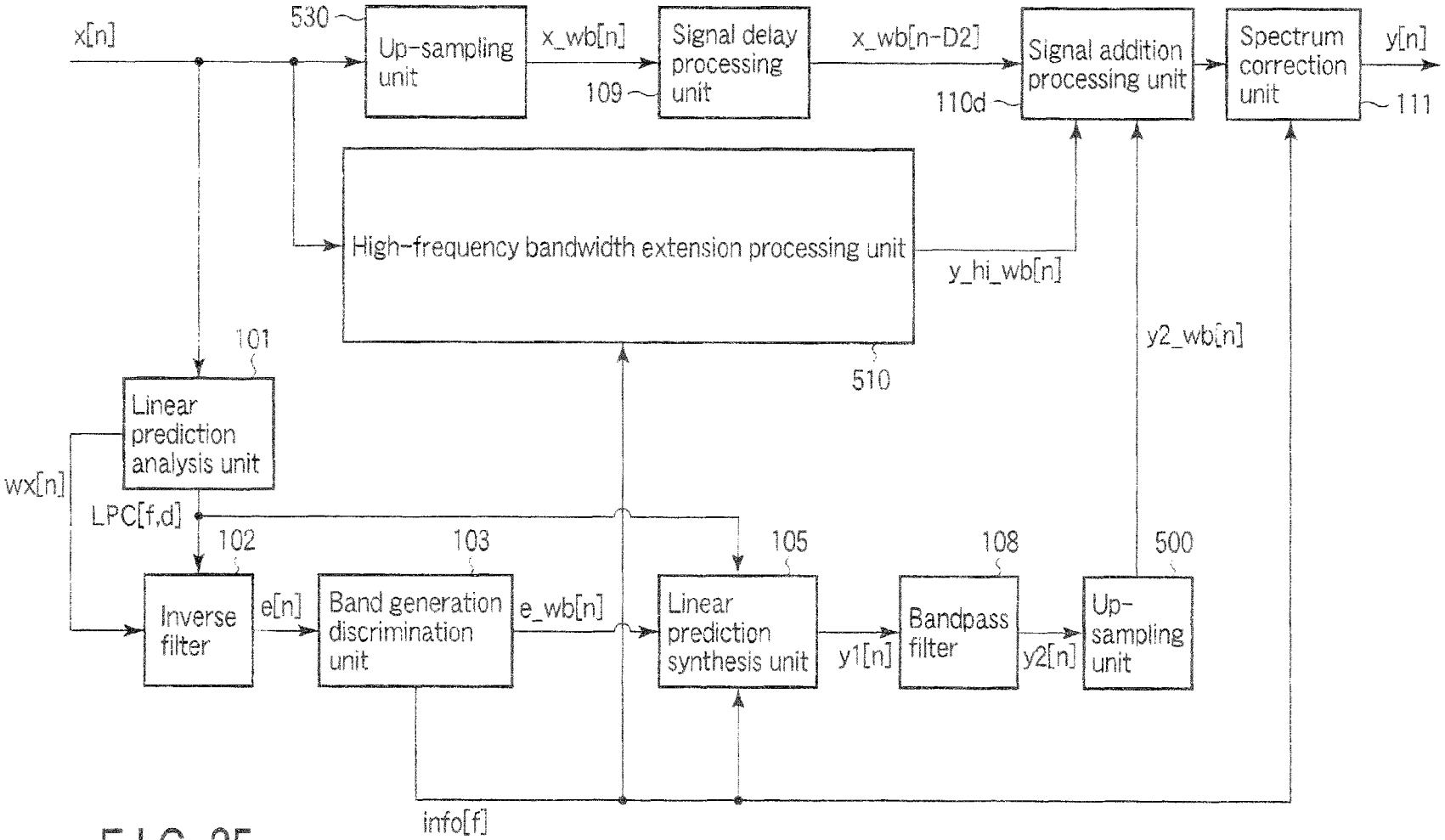
FIG. 25 is a block diagram showing another modification of the sixth embodiment of the signal bandwidth extension apparatus shown in FIG. 20.

A spectrum correction unit 111 may be added, as shown in FIG. 25.

The spectrum correction unit 111 applies spectrum correction processing that emphasizes or attenuates signal for respective frequency bands to the wideband signal outputs from the signal addition processing unit 110*d* based on the control information info[f] obtained by the band generation discrimination unit 103, and outputs the spectrum-corrected signal as signal y[n]. More specifically, the spectrum correction unit 111 transforms wideband signal of the data length 2N output from the signal addition processing unit 110*d* into those of a frequency domain by processing such as FFT using 2N points, thus obtaining frequency spectra Y'[f,ω]. However, the size of the FFT is not limited to this. For example, signal to which the FFT is applied is zero-padded to convert the data length into the power of 2, so as to set the size of the FFT to be the power of 2. In case of the control information info[f]=1 obtained by the band generation discrimination unit 103, since a speech has a low voice pitch, a spectrum correction gain G'[f,ω] is set to be equal to or larger than 1 in a band fs_wb_low [Hz] to fs_nb_low [Hz] to be extended. In case of the control information info[f]=0, since a speech has a high voice pitch, and no signals are included in the band fs_wb_low [Hz] to fs_nb_low [Hz] to be extended, the spectrum correction gain G'[f,ω] is set to be equal to or smaller than 1. Alternatively, in case of the control information info [f]=1 obtained by the band generation discrimination unit 103, since a speech has a low voice pitch, the spectrum correction gain G'[f,ω] is set to be equal to or larger than 1 in the band fs_nb_high [Hz] to fs_wb_high [Hz] to be extended, so as to correct a frequency balance to enhance perceptional frequency characteristic. Then, G'[f,ω]=1 is set for frequency bins of other bands, and the frequency spectra Y'[f,ω] are multiplied by the spectrum correction gains G'[f,ω], and these products are transformed to those of a time domain by, e.g., IFFT, thereby obtaining wideband signal that has undergone the spectrum correction processing.

With this arrangement as well, the same effects as in the sixth embodiment can be obtained.

Also, according to this arrangement, since the spectrum, correction unit 111 corrects the frequency balance of the wideband signal in accordance with the control information obtained by the band generation discrimination unit 103, band separation can be enhanced according to input signal. Also, since the spectrum correction unit 111 can emphasize a band to be extended, the sound quality of a widebanded, bandwidth-extended signal, can be improved.

Note that the present invention is not limited to the aforementioned embodiments intact, and can be embodied by modifying required constituent elements without departing from the scope of the invention when it is practiced. By appropriately combining a plurality of required constituent elements disclosed in the embodiments, various inventions can be formed. For example, some of all the required constituent elements disclosed in the embodiments may be deleted. Furthermore, required constituent elements described in different embodiments may be appropriately combined.

Figure 26:
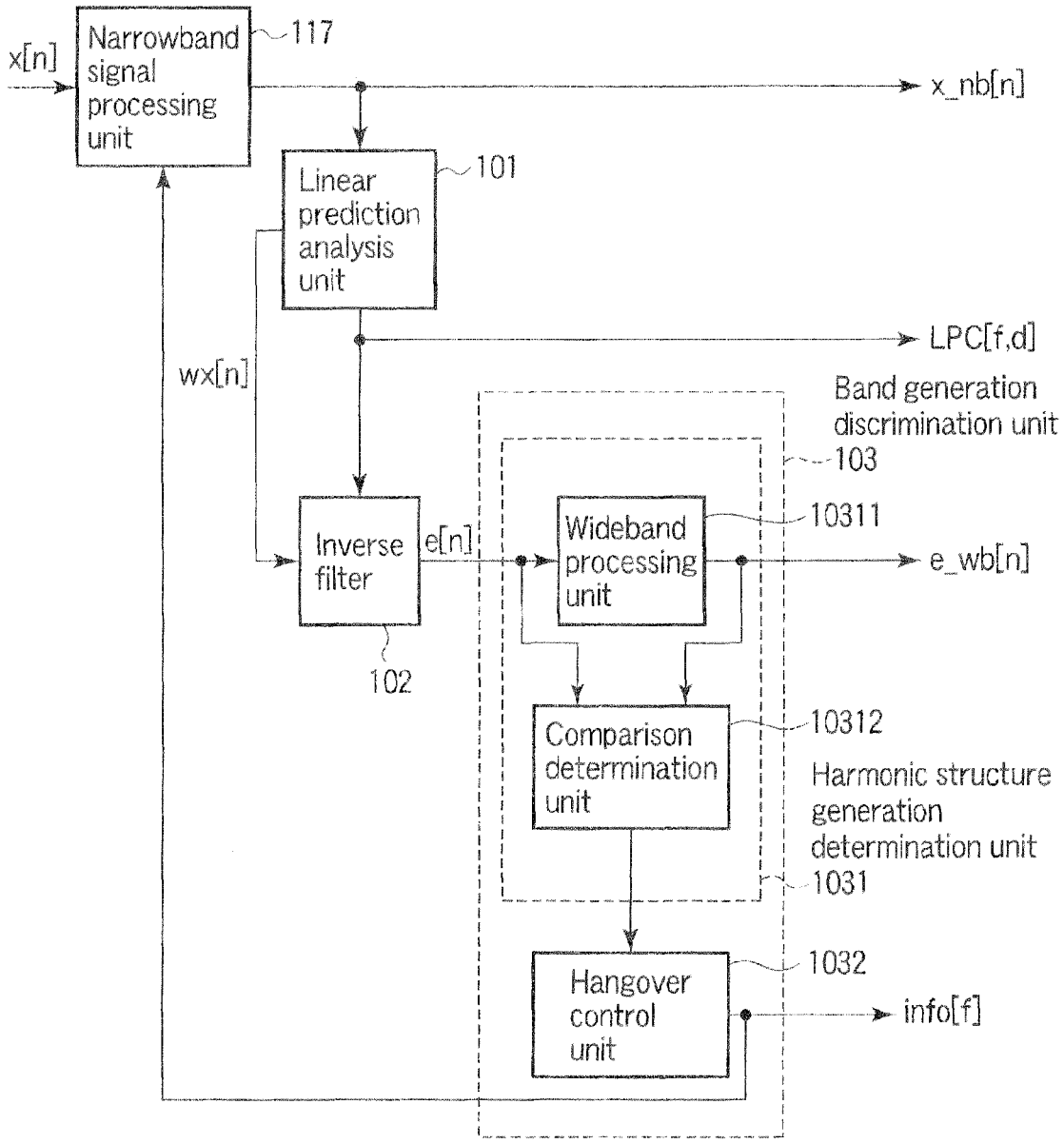
FIG. 26 is a block diagram showing a modification of the signal bandwidth extension apparatus according to the present invention.

As an example, for instance, as shown in FIG. 26, a narrowband signal processing unit 117 which applies signal processing to input signal x[n] is added before the bandwidth extension processing unit 3, and output x_nb[n] from the narrowband signal processing unit 117 are input to the bandwidth extension processing unit 3 as input signal x[n] in the first to sixth embodiments. The narrowband signal processing unit 117 may implement noise suppression processing, filter processing that emphasizes a specific band, or the like, and operates to change processing using control information info[f−1] one frame before output from the band generation discrimination unit 103. When the narrowband signal, processing unit 117 implements the noise suppression processing, and when the control information info[f−1]=1, it executes delicate processing that sufficiently considers a low band equal to or lower than a frequency ωp[f] extracted as a peak. When the control information info[f−1]=0, the narrowband signal processing unit 117 executes processing that considers a low band equal to or lower than the frequency ωp[f] extracted as a peak unimportant and roughly handles that band. That is, when the narrowband signal processing unit 117 implements the noise suppression processing, and when the control information info[f−1]=1, it weakens a noise suppression effect of a low band compared to the case of the control information info[f−1]=0, so as to prevent a speech from being excessively distorted. For example, when the control information info[f−1]=0, the narrowband signal processing unit 117 applies strong noise suppression processing to a low band equal to or lower than the frequency ωp[f]. For other bands or in case of the control information info[f−1]=1, the narrowband signal processing unit 117 executes normal noise suppression processing. When the narrowband signal processing unit 117 implements the filter processing that emphasizes a specific band, and when the control information info[f−1]=0, it emphasizes the peak of a low band stronger than when the control information info[f−1]=1. For example, when the control information info[f−1]=0, the narrowband signal processing unit 117 emphasizes a band around the frequency ωp[f] to emphasize a peak and the fundamental frequency. For other bands or in case of the control information info[f−1]=1, the narrowband signal processing unit 117 skips the emphasis processing. With this processing, when a fundamental frequency signal is not lacked from the input signal, since the narrowband signal processing unit 117 emphasizes the fundamental frequency or removes unnecessary noise components in advance, a harmonic structure can be precisely generated in a voiced sound in the wideband processing of the subsequent bandwidth extension processing unit 3, thus generating a bandwidth-extended signal which is more faithful to an original sound and has good sound quality.

Figure 27:
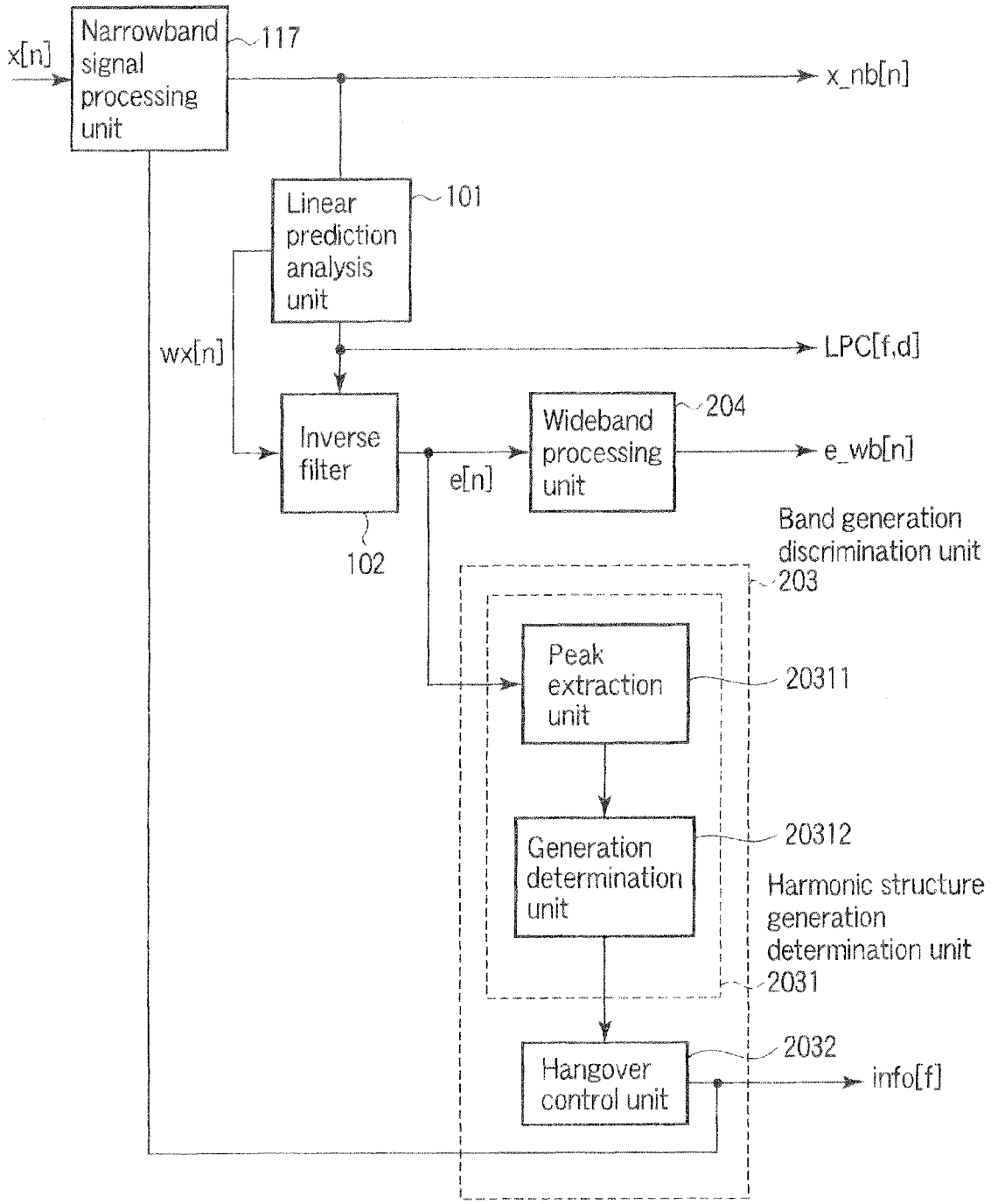
FIG. 27 is a block diagram showing another modification of the signal bandwidth extension apparatus according to the present invention.

Likewise, as shown in FIG. 27, the narrowband signal processing unit 117 which applies signal processing to input signal x[n] is added before the bandwidth extension processing unit 3, and output x_nb[n] from the narrowband signal processing unit 117 are input to the bandwidth extension processing unit 3 as input signal x[n] in the first to sixth embodiments. The narrowband signal processing unit 117 may execute noise suppression processing, filter processing that emphasizes a specific band, or the like, and operates to change processing using control information info[f−1] one frame before output from the bandwidth extension processing unit 3 by reading the frequency ωp[f] as a frequency ωp1[f], thus obtaining the same effects.

As another example, for instance, as shown in FIG. 1B, the signal bandwidth extension apparatus is applied to a digital audio player, and music and audio signal is assumed as input signal x[n]. In this case, an arrangement obtained by excluding the linear prediction analysis unit 101, inverse filter 102, and linear prediction synthesis unit 105 shown in FIGS. 12 and 13 is used. That is, the input signal x[n] is input to the band generation discrimination unit 103, and widebanded signal output from the band generation discrimination unit 103 is input to the bandpass filter 108. Wideband signal which is output from the bandpass filter 108 and is extended, and from which a band is extracted, and control information info[f] output from the band generation discrimination unit 103 are input to the signal addition processing unit 110*b*. The signal addition processing unit 110*b* controls to add or not to add the wideband signal output from, the bandpass filter 108 according to the control information info[f]. In this way, the same effects can be obtained.

Even when an input signal is not a monaural signal but stereo signals, the bandwidth extension processing of the bandwidth extension processing unit 3 is applied to, e.g., L (left) and R (right) channels, respectively, or to a sum signal (a sum of L and R channel signals) and a difference signal (a difference of an R channel signal from an L channel signal), thus obtaining the same effects.

In addition, even when various modifications may be made without departing from the scope of the present invention, the present invention can be carried out.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A signal band extension apparatus, which extends a band of an input signal, the apparatus comprising:

a wideband processing module configured to extend a band of the input signal;

a determination module configured to determine whether or not an input signal whose band has been extended by the wideband processing module comprises a peak component greater than a predetermined threshold in the extended band; and a controller configured to extend the band of the input signal by using the input signal whose band has been extended by the wideband processing module when the determination module determines that the input signal comprises the peak component, and not to perform an extension of the band of the input signal by using the input signal whose band has been extended by the wideband processing module when the determination module determines that the input signal does not comprise the peak component.

2. The apparatus of claim 1, wherein the wideband processing module comprises:

an analysis module configured to analyze the input signal to obtain a narrow band spectrum parameter and a narrow band excitation signal; and a band extension module configured to extend a band of the narrow band excitation signal obtained by the analysis module based on a predetermined non-linear function, wherein the determination module is configured to determine whether or not the narrow band excitation signal extended by the band extension module comprises a peak component greater than a predetermined threshold in the extended band, and wherein the controller is configured to extend the band of the input signal based on a determination result by the determination module and a comparison result of an input signal and output signal of the band extension module.

3. The apparatus of claim 2, further comprising:

a synthesis module configured to synthesize a band extended narrowband excitation signal with the narrowband spectral parameter to generate a wideband signal, wherein the controller is configured to execute a dip emphasizing process to emphasize a dip of the wideband signal when a band is to be extended, and not to execute the dip emphasizing process when a band is not to be extended.

4. The apparatus of claim 2, wherein the controller is configured to (i) when a band is to be extended, synthesize a band extended narrowband excitation signal with the narrowband spectral parameter, execute a filter processing on a synthesized signal, add a filtered signal to the input signal, and output an added signal, and (ii) when a band is not to be extended, execute a filter processing on a band extended narrowband excitation signal, add a filtered signal to the input signal, and output an added signal.

5. The apparatus of claim 2, wherein the controller is configured to (i) when a band is to be extended, synthesize a band extended narrowband excitation signal with the narrowband spectral parameter, execute a filter processing on a synthesized signal, add a filtered signal to the input signal, and output an added signal, and (ii) when a band is not to be extended, synthesize a silent signal with the narrowband spectral parameter, execute a filter processing on a synthesized signal, add a filtered signal to the input signal, and output an added signal.

6. The apparatus of claim 2, wherein the controller is configured to synthesize a band extended narrowband excitation signal with the narrowband spectral parameter, extract a component of a band to be extended, add an extracted component to the input signal, and output an added signal, when a band is to be extended.

7. The apparatus of claim 2, wherein the controller is configured to extend a low-frequency component when a band is to be extended, and not to extend the low-frequency component when a band is not to be extended.

8. The apparatus of claim 7, wherein the controller comprises a high-frequency component extension module configured to subject the narrowband excitation signal to a band-pass filtering and extend a high-frequency component of a filtered signal when a low-frequency component is to be extended, and to extend a high-frequency component of the narrowband excitation signal without being subjected to the band-pass filtering when the low-frequency component is not to be extended.

9. The apparatus of claim 7, wherein the controller comprises a high-frequency component extension module configured to subject the narrowband excitation signal to a first band-pass filtering and extend a high-frequency component of a filtered signal when a low-frequency component is to be extended, and to subject the narrowband excitation signal to a second band-pass filtering with a lowest pass frequency lower than a lowest pass frequency of the first band-pass filtering and extend a high-frequency component of a filtered signal when a low-frequency component is not to be extended.

10. The apparatus of claim 1, wherein the peak component determined by the determination module comprises a fundamental frequency of the input signal.

11. The apparatus of claim 1, wherein the controller is configured to perform a spectrum correction, and a degree of the spectrum correction to be performed for a band to be extended when a band is to be extended is stronger than a degree of the spectrum correction to be performed when a band is not to be extended.

12. The apparatus of claim 1, wherein the controller comprises a noise suppression module configured to perform a noise suppression, and a degree of the noise suppression to be performed for a low-frequency component when a band is to be extended is weaker than a degree of the noise suppression to be performed when a band is not to be extended.

13. The apparatus of claim 1, wherein the controller comprises a peak emphasis module configured to emphasize, when a band is to be extended, a peak of a low-frequency component with respect to an input signal of a next frame to be stronger than when a band is not to be extended.

14. A signal band extension apparatus, which extends a band of an input signal, the apparatus comprising:

a peak extraction module configured to extract at least two different peak frequencies from the input signal;

a determination module configured to determine whether or not a peak component of the input signal is lacking from the band to be extended based on a difference between the at least two peak frequencies extracted by the peak extraction module, the band to be extended being lower than the at least two peak frequencies; and a controller configured to extend the band of the input signal when the determination module determines that the peak component is lacking, and not to extend the band of the input signal when the determination module determines that the peak component is not lacking.

15. The apparatus of claim 14, wherein the peak extraction module comprises:

an analysis module configured to analyze the input signal to obtain a narrow band spectrum parameter and a narrow band excitation signal; and an extractor configured to extract at least two different peak frequencies from the narrow band excitation signal obtained by the analysis module, wherein the determination module is configured to determine whether or not the peak component of the input signal is lacking from the band to be extended based on a difference between the at least two peak frequencies extracted by the extractor.

16. The apparatus of claim 15, further comprising:

a synthesis module configured to synthesize a band extended narrowband excitation signal with the narrowband spectral parameter to generate a wideband signal, wherein the controller is configured to execute a dip emphasizing process to emphasize a dip of the wideband signal when a band is to be extended, and not to execute the dip emphasizing process when a band is not to be extended.

17. The apparatus of claim 15, wherein the controller is configured to (i) when a band is to be extended, synthesize a band extended narrowband excitation signal with the narrowband spectral parameter, execute a filter processing on a synthesized signal, add a filtered signal to the input signal, and output an added signal, and (ii) when a band is not to be extended, execute a filter processing on a band extended narrowband excitation signal, add a filtered signal to the input signal, and output an added signal.

18. The apparatus of claim 15, wherein the controller is configured to (i) when a band is to be extended, synthesize a band extended narrowband excitation signal with the narrowband spectral parameter, execute a filter processing on a synthesized signal, add a filtered signal to the input signal, and output an added signal, and (ii) when a band is not to be extended, synthesize a silent signal with the narrowband spectral parameter, execute a filter processing on a synthesized signal, add a filtered signal to the input signal, and output an added signal.

19. The apparatus of claim 15, wherein the controller is configured to synthesize a band extended narrowband excitation signal with the narrowband spectral parameter, extract a component of a band to be extended, add an extracted component to the input signal, and output an added signal, when a band is to be extended.

20. The apparatus of claim 15, wherein the controller is configured to extend a low-frequency component when a band is to be extended, and not to extend the low-frequency component when a band is not to be extended.

21. The apparatus of claim 20, wherein the controller comprises a high-frequency component extension module configured to subject the narrowband excitation signal to a band-pass filtering and extend a high-frequency component of a filtered signal when a low-frequency component is to be extended, and to extend a high-frequency component of the narrowband excitation signal without being subjected to the band-pass filtering when the low-frequency component is not to be extended.

22. The apparatus of claim 20, wherein the controller comprises a high-frequency component extension module configured to subject the narrowband excitation signal to a first band-pass filtering and extend a high-frequency component of a filtered signal when a low-frequency component is to be extended, and to subject the narrowband excitation signal to a second band-pass filtering with a lowest pass frequency lower than a lowest pass frequency of the first band-pass filtering and extend a high-frequency component of a filtered signal, when a low-frequency component is not to be extended.

23. The apparatus of claim 14, wherein the peak component determined by the determination module comprises a fundamental frequency of the input signal.

24. The apparatus of claim 14, wherein the controller is configured to perform a spectrum correction, and a degree of the spectrum correction to be performed for a band to be extended when a band is to be extended is stronger than a degree of the spectrum correction to be performed when a band is not to be extended.

25. The apparatus of claim 14, wherein the controller comprises a noise suppression module configured to perform a noise suppression, and a degree of the noise suppression to be performed for a low-frequency component when a band is to be extended is weaker than a degree of the noise suppression to be performed when a band is not to be extended.

26. The apparatus of claim 14, wherein the controller comprises a peak emphasis module configured to emphasize, when a band is to be extended, a peak of a low-frequency component with respect to an input signal of a next frame to be stronger than when a band is not to be extended.

* * * * *